US011603809B2

(12) United States Patent
Ishihara et al.

(10) Patent No.: US 11,603,809 B2
(45) Date of Patent: Mar. 14, 2023

(54) MALFUNCTION DIAGNOSTIC DEVICE FOR LEAKAGE DIAGNOSTIC DEVICE

(71) Applicant: DENSO CORPORATION, Kariya (JP)

(72) Inventors: Keiichirou Ishihara, Kariya (JP); Taiki Yasuzaka, Kariya (JP); Yasuo Kato, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 17/486,694

(22) Filed: Sep. 27, 2021

(65) Prior Publication Data

US 2022/0099051 A1 Mar. 31, 2022

(30) Foreign Application Priority Data

Sep. 30, 2020 (JP) ..... JP2020-165653

(51) Int. Cl.
*F02M 25/08* (2006.01)
*F02D 41/00* (2006.01)
*F02D 41/22* (2006.01)

(52) U.S. Cl.
CPC ..... *F02M 25/0818* (2013.01); *F02D 41/0032* (2013.01); *F02D 41/22* (2013.01); *F02M 25/0836* (2013.01); *F02D 2041/225* (2013.01)

(58) Field of Classification Search
CPC ..... F02M 25/0818; F02M 25/0836; F02D 41/0032; F02D 41/22; F02D 41/1454; F02D 2041/225
See application file for complete search history.

(56) References Cited

U.S. PATENT DOCUMENTS

| | | | | |
|---|---|---|---|---|
| 11,359,582 | B1 * | 6/2022 | Dudar | F02M 25/0818 |
| 2014/0026867 | A1 * | 1/2014 | Itoh | F02M 25/0854 123/520 |
| 2015/0083087 | A1 * | 3/2015 | Pearce | F02M 25/0809 123/520 |
| 2016/0123280 | A1 * | 5/2016 | Makino | F02M 25/0836 123/519 |
| 2020/0182174 | A1 | 6/2020 | Dudar | |
| 2020/0309069 | A1 * | 10/2020 | Eser | B01D 53/9454 |
| 2021/0033047 | A1 * | 2/2021 | Shinaberry | F02M 25/0836 |

* cited by examiner

*Primary Examiner* — George C Jin
(74) *Attorney, Agent, or Firm* — Nixon & Vanderhye P.C.

(57) ABSTRACT

A leakage diagnostic device diagnoses leakage of evaporated fuel in an evaporative fuel treatment device. The evaporative fuel treatment device purges evaporated fuel, which is generated in a fuel tank and adsorbed on a canister, to an intake passage. The leakage diagnostic device includes a vent valve that blocks a first atmospheric passage, which connects the canister with an atmospheric opening, and a pump that pressurizes and depressurizes a second atmospheric passage, which is a bypass passage of the first atmospheric passage. The malfunction diagnostic device diagnoses malfunction of the leakage diagnostic device based on an output value of a pressure sensor that detects pressure in a passage connected to the canister.

8 Claims, 38 Drawing Sheets

MALFUNCTION DIAGNOSTIC DEVICE FOR LEAKAGE DIAGNOSTIC DEVICE

CROSS REFERENCE TO RELATED APPLICATION

The present application claims the benefit of priority from Japanese Patent Application No. 2020-165653 filed on Sep. 30, 2020. The entire disclosures of all of the above applications are incorporated herein by reference.

TECHNICAL FIELD

The present disclosure relates to a malfunction diagnostic device for a leakage diagnostic device.

BACKGROUND

Conventionally, a known evaporative fuel treatment device collects evaporative fuel from a fuel tank and supplies the evaporative fuel to an intake passage of an engine. A device for diagnosing leakage of a member, a pipe, and the like in an evaporative fuel treatment device is also known.

SUMMARY

According to an aspect of the present disclosure, a malfunction diagnostic device is configured to perform malfunction diagnosis of a leakage diagnostic device, which is provided to an atmospheric passage in an evaporative fuel treatment device, to diagnose leakage of evaporated fuel.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
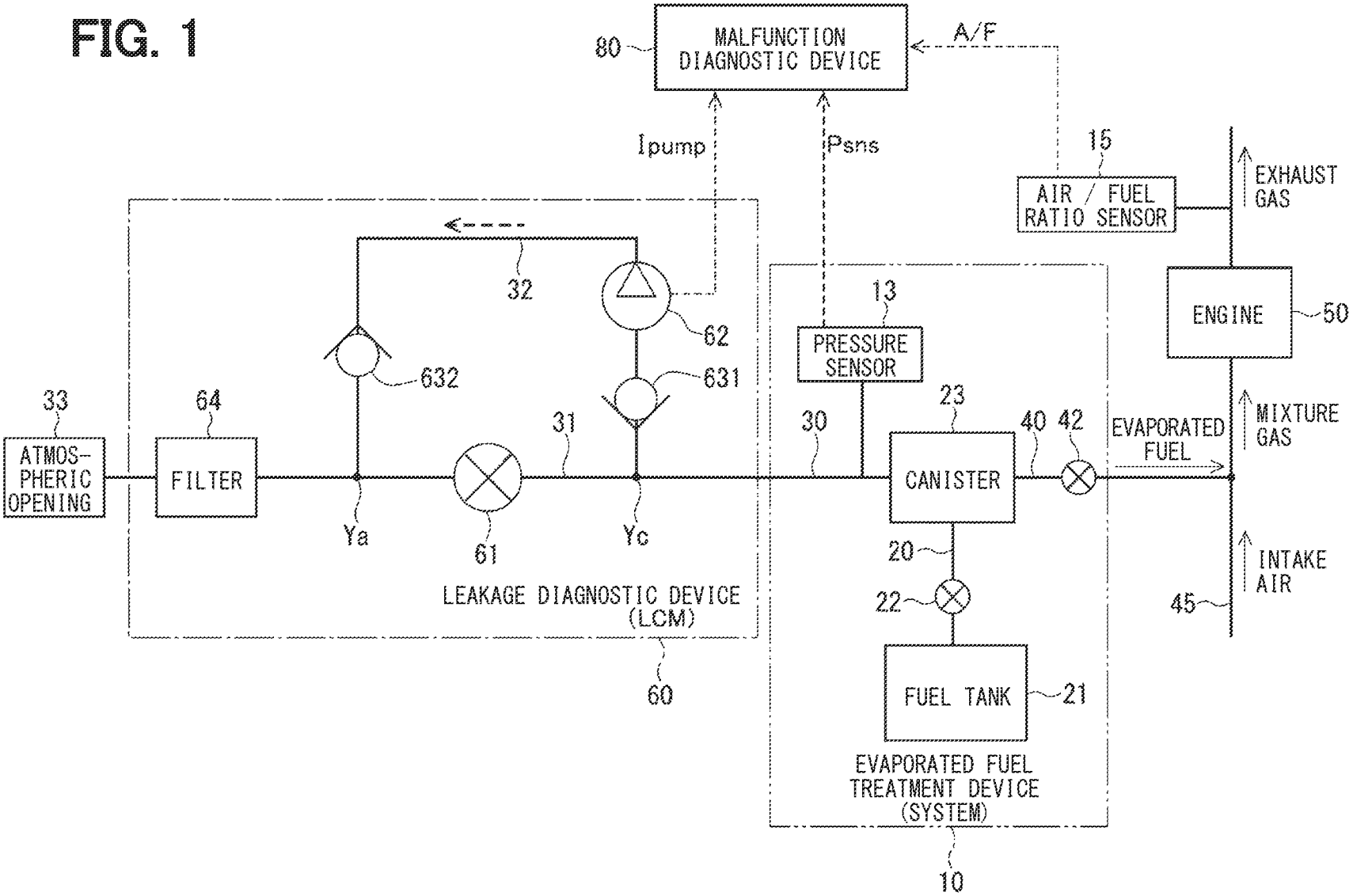
FIG. 1 is a diagram showing a configuration of an evaporative fuel treatment device and a leakage diagnostic device according to first to third embodiments.

Hereinafter, examples of the present disclosure will be described.

According to an example of the present disclosure, a device diagnoses leakage of a member, a pipe, and the like in an evaporative fuel treatment device. The evaporative fuel treatment device collects evaporative fuel from a fuel tank and supplies the evaporative fuel to an intake passage of an engine.

According to an example of the present disclosure, a leakage diagnostic device for an evaporative fuel treatment device includes a canister vent valve CVV, a vacuum pump, and two check valves CV1, CV2. The canister vent valve is provided in a first flow path between a canister and the atmosphere. The pump and the check valves are provided in a second flow path formed in parallel with a first flow path.

In the device of this example, in a case where the leakage diagnostic device fails and where a determination result of "leakage occurrence" is made in a leakage diagnosis, the device may become incapable of determining whether the determination result is due to leakage in the evaporative fuel treatment device or due to a malfunction of the leakage diagnostic device.

The present disclosure relates to a malfunction diagnostic device configured to perform malfunction diagnosis of a leakage diagnostic device 60, which is provided to an atmospheric passage, to diagnose leakage of evaporated fuel in an evaporative fuel treatment device 10. The evaporative fuel treatment device purges the evaporative fuel, which is adsorbed on a canister 23, into an intake passage 45 through a purge passage 40. The canister is connected to a fuel tank 21 through a vapor passage 20 and is connected to an atmospheric opening 33 through an atmospheric passage 30.

The leakage diagnostic device includes a vent valve 61, a pump 62, and at least one check valve 631, 632. The vent valve 61 may correspond to a canister vent valve. The pump and the check valve may correspond to a vacuum pump and a check valves CV1 and CV2.

The vent valve is configured to block a first atmospheric passage 31, which is a main passage of the atmospheric passage and connects the canister with the atmospheric opening. The pump is provided to a second atmospheric passage 32, which is a bypass passage of the first atmospheric passage and connects the canister with the atmospheric opening, and is configured to pressurize and depressurize the second atmospheric passage. For example, when the pump pressure-feeds gas in the second atmospheric passage from the canister side toward the atmosphere opening, the second atmospheric passage between the canister and the pump is depressurized. The at least one check valve is provided to the second atmospheric passage and seal the flow of gas in a direction opposite to the pumping direction of the pump.

The malfunction diagnostic device according to an example of the present disclosure is configured to diagnose malfunction in the malfunction diagnosis based on an output value of a pressure sensor 13 that is configured to detect pressure in a passage connected to the canister.

The malfunction diagnostic device according to an example of the present disclosure diagnoses a malfunction in the malfunction diagnosis based on a current value of the pump.

The malfunction diagnostic device according to an example of the present disclosure diagnoses malfunction in the malfunction diagnosis based on an output value of an air-fuel ratio sensor 15 in a state where a purge valve 42, which is provided to a purge passage, is opened to purge evaporated fuel from the canister to the intake passage. The air-fuel ratio sensor detects the air-fuel ratio of air-fuel mixture supplied to the engine through the intake passage.

Hereinafter, multiple embodiments of a malfunction diagnostic device according to the present invention will be described with reference to the drawings. This malfunction diagnostic device performs a malfunction diagnosis on a leakage diagnostic equipment that performs a leakage diagnosis on a fuel vapor treatment device for a vehicle. The fuel vapor treatment device collects fuel evaporated from a fuel tank with a canister and supplies the collected vapor to an intake passage. Hereinafter, the evaporative fuel treatment device is also referred to as a "system". The leakage diagnostic device is also referred to as a "leakage check module (LCM)".

(Overall Configuration of Evaporative Fuel Treatment Device and Leakage Diagnostic Device)

First, the overall configuration of the device will be described with reference to FIG. 1. The system, that is, an evaporative fuel treatment device 10 includes a fuel tank 21, a vapor passage 20, a canister 23, an atmospheric passage 30, a purge passage 40, and the like.

The fuel tank 21 in which the fuel is stored is connected to the canister 23 through the vapor passage 20. The canister 23 adsorbs evaporated fuel. Further, in the example of FIG. 1, a sealing valve 22 is provided to the vapor passage 20. Generally, the sealing valve 22 shuts off the fuel tank 21 from the canister 23 so that the fuel tank 21 is sealed, except when the vehicle is refueled. It is noted that, the sealing valve 22 may not be provided.

The atmospheric passage 30 connects the canister 23 with an atmospheric opening 33. The purge passage 40 connects the canister 23 with an intake passage 45. A purge valve 42 is provided in a midway portion of the purge passage 40. In a state where the purge valve 42 is open, evaporated fuel adsorbed on the canister 23 is purged to the intake passage 45, together with air introduced through the atmospheric passage 30, through the purge passage 40.

In this way, the evaporative fuel treatment device 10 purges the evaporative fuel adsorbed on the canister 23 into the intake passage 45 through the purge passage 40. At this time, an amount of evaporated fuel to be purged is adjusted according to the opening degree of the purge valve 42. Air-fuel mixture in which intake air and the evaporated fuel are mixed in the intake passage 45 is supplied to an engine 50.

The leakage diagnostic device 60 is provided to the atmospheric passage 30 to diagnose leakage of the evaporative fuel in the evaporative fuel treatment device 10. In the leakage diagnostic device 60, two passages constituting the atmospheric passage 30 are formed in parallel. The first atmospheric passage 31, as a main passage of the atmospheric passage 30, connects the canister 23 with the atmospheric opening 33. The second atmospheric passage 32, as a bypass passage of the first atmospheric passage 31, connects the canister 23 with the atmospheric opening 33. Of confluence points between the first atmospheric passage 31 and the second atmospheric passage 32, a confluence point on the side of the canister 23 is referred to as Yc, and a confluence point on the side of the atmosphere opening 33 is referred to as Ya.

The leakage diagnostic device 60 includes the vent valve 61, a pump 62, two check valves 631, 632, and a filter 64. The vent valve 61 is configured to shut off the first atmospheric passage 31. The vent valve 61 of the present embodiment includes a normally open solenoid valve.

The pump 62 is an electric pump provided to the second atmospheric passage 32 and is driven by an electric power. Pumps 62 and 62X of each embodiment is configured to pressurize or depressurize the second atmospheric passage 32. Of the pumps 62 and 62X, the pumps 62 of the first to third embodiments is configured to pump gas in the second atmospheric passage 32 from the side of the canister 23 toward the atmospheric opening 33. The operation of the pump 62 depressurizes the second atmospheric passage 32 between the canister 23 and the pump 62. In the fourth embodiment described later, the pump 62X is opposite in the pumping direction.

The check valves 631 and 632 are provided to the second atmospheric passage 32 and seal the flow of gas in a direction opposite to the pumping direction of the pump 62. Specifically, the first check valve 631 is provided between the confluence point Yc on the side of the canister 23 and the pump 62. The second check valve 632 is provided between the confluence point Ya on the side of the atmosphere opening 33 and the pump 62. The number of the check valves is not limited to two and may be one or more. Further, the check valve may employ various structures. The filter 64 is provided to the atmospheric passage 30 between the confluence point Ya on the side of the atmospheric opening 33 and the atmospheric opening 33.

Further, as a sensor normally used for the leakage diagnosis by the leakage diagnostic device 60, a pressure sensor 13 is provided for detecting the pressure in the passage connected to the canister 23. In the example of FIG. 1, the pressure sensor 13 is provided in the atmospheric passage 30 between the confluence point Yc on the side of the canister 23 and the canister 23. In addition or alternatively, for example, the pressure sensor 13 may be provided to the first atmospheric passage 31 between the confluence point Yc and the vent valve 61 and/or may be provided to the second atmospheric passage 32 between the confluence point Yc and the first check valve 631. In addition or alternatively, the pressure sensor 13 may be provided to the vapor passage 20 between the sealing valve 22 and the canister 23.

Further, an air-fuel ratio sensor (lambda sensor) 15 is provided on the side of the exhaust of the engine 50 for detecting an air-fuel ratio of the air-fuel mixture supplied to the engine 50 through the intake passage 45 generally for engine control.

Figure 2:
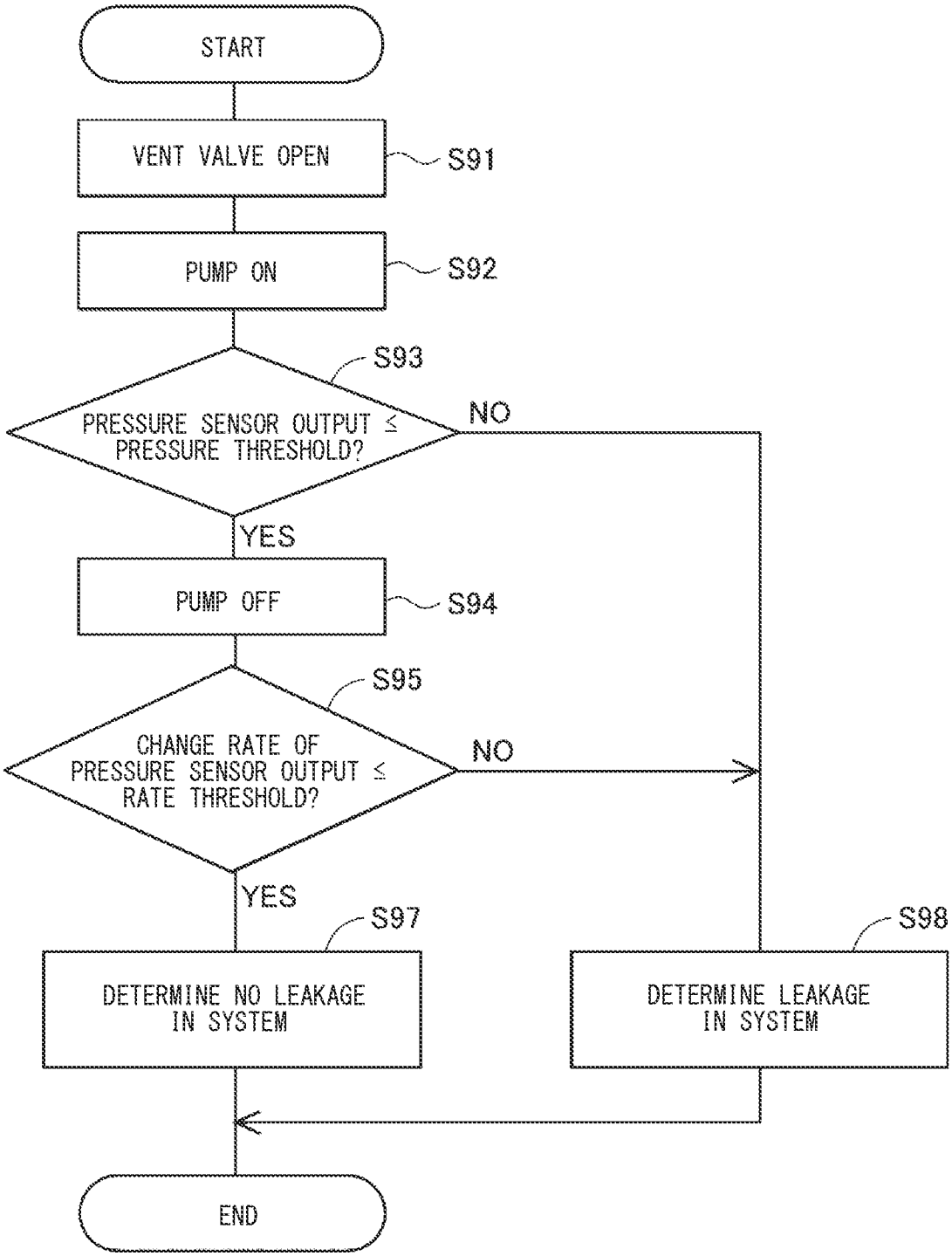
FIG. 2 is a flowchart showing a leakage diagnosis of a comparative example.

The leakage diagnosis method according to a comparative example is shown in the flowchart of FIG. 2. Hereinafter, in the description of the flowchart, a symbol "S" indicates a step. At the start of FIG. 2, the purge valve 42 is closed.

At S91, the vent valve 61 corresponding to the canister vent valve is closed. When the pump 62 is turned on in S92, when there is no leakage in the leakage diagnostic device 60, the passage on the side of the canister 23 is depressurized from the atmospheric pressure to the negative pressure. In S93, it is determined whether the output value of the pressure sensor 13 is equal to or less than a predetermined pressure threshold value (<atmospheric pressure). The pump 62 is turned off in S94. In S96, it is determined whether or not the rate of change of the output value of the pressure sensor 13 after the pump is turned off is equal to or less than a predetermined speed threshold value. When determination of YES is made in S96, it is determined in S97 that there is no leakage in the system. When determination of NO is made in S93 or when determination of NO is made in S95, it is determined in S98 that there is a leakage in the system.

It is noted that, the comparative example supposes that the leakage diagnostic device 60 has not failed. In other words, the comparative example does not consider the possibility of malfunction of each element of the leakage diagnostic device 60. Therefore, in the device according to the comparative example, in a case where the leakage diagnostic device 60 fails and where a determination result of "leakage occurrence" is made in a leakage diagnosis, the device is incapable of determining whether the determination result is due to leakage in the evaporative fuel treatment device 10 or due to a malfunction of the leakage diagnostic device 60. In order to solve this problem, a malfunction diagnostic device 80 of the present embodiment enables diagnosis of the malfunction of the leakage diagnostic device 60.

The malfunction diagnostic device 80 of this embodiment performs the malfunction diagnosis of the leakage diagnostic device 60 based on based on one or more parameters of (1) the output value Psns of the pressure sensor 13, (2) the current value Imp of the pump 62, and (3) the output value A/F of the air-fuel ratio sensor 15. Hereinafter, the output value Psns of the pressure sensor 13 is referred to as "pressure sensor output value Psns". The current value Ipump of the pump 62 is referred to as "pump current Ipump". The output value A/F of the air-fuel ratio sensor 15 is referred to as "air-fuel ratio sensor output value A/F".

Specifically, in the first embodiment, the malfunction diagnosis is performed based on the pressure sensor output value Psns. In the second embodiment, the malfunction diagnosis is performed based on the pressure sensor output value Psns and the pump current Imp. In the third embodiment, the malfunction diagnosis is performed based on the air-fuel ratio sensor output value A/F. As shown by the dashed arrow in FIG. 1, the malfunction diagnostic device 80 need not to regularly acquire the three parameters, and only the parameter(s) to be used may be acquired according to the embodiment.

(Malfunction Diagnostic for Leakage Diagnostic Device)

Next, the malfunction diagnosis of the leakage diagnostic device 60 by using the malfunction diagnostic device 80 will be described for each embodiment based on the flowchart and the time chart. In the first embodiment and the second embodiment, a part of the flowchart is shared, and substantially the same steps are assigned with the same step numbers, respectively. Further, the flowcharts of the first embodiment and the second embodiment are represented over two drawings via the connection symbols J1 and J2, respectively. Some step numbers of the determination steps in the 60*s* correspond to codes of the failed components.

The malfunction diagnosis is performed while the vehicle is parked, for example, after elapse of several hours subsequent to turn off of the ignition. In the second embodiment and the third embodiment, the leakage diagnosis of the system itself is performed at the same time as the malfunction diagnosis of the leakage diagnostic device ("LCM" in the drawing) 60. As a rough indication, the "large leak" of the system represents leakage that is equal to or higher than the flow rate when the vent valve 61 is opened and is assumed when the valve is not closed or when the pipe connection is disconnected. On the other hand, "small leakage" represents a minute leakage due to a pinhole or the like.

Each time chart shows ON/OFF of the purge valve 42, the vent valve 61, and the pump 62 in common. For the normally closed purge valve 42, ON indicates open, and OFF indicates close. For the normally open vent valve 61, ON indicates close, and OFF indicates open. In the first and second embodiments, the purge valve 42 is always closed.

Further, the time chart of the first embodiment shows the pressure sensor output value Psns. Some drawings further show the system temperature, i.e. the ambient temperature of the leakage diagnostic device 60. Herein, a case where the system temperature increases with respect to the initial temperature is shown. The time chart of the second embodiment shows the pump current Impump and the pressure sensor output value Psns. In the first to third embodiments, when the pump 62 operates normally, the pressure sensor output value Psns changes from the atmospheric pressure to the negative side. The time chart of the third embodiment shows the air-fuel ratio sensor output value A/F.

Hereinafter, the flow chart and the time chart will be described with reference to each other. The numbers of drawings in parentheses in the steps of the flowchart indicate the numbers of drawings of the corresponding time charts, respectively. It is noted that, the main body that turns on/off the pump 62 and the vent valve 61 at each step is the malfunction diagnostic device 80. However, in a case where the subject is described each time, such as "the malfunction diagnostic device 80 turns on the pump 62", the description becomes redundant. Therefore, basically, the pump 62 and the vent valve 61 are described in the passive voice as the subject, such as "the pump 62 is turned on".

First Embodiment

The malfunction diagnosis of the first embodiment will be described with reference to FIGS. 3 to 12. The pressure thresholds as follows have the relationship of "PE>PD>atmospheric pressure>PC>PA>PB" and "atmospheric pressure>PF>PA". At the start in FIG. 3, the purge valve 42 is closed. At time t1, the vent valve 61 is closed in S11, and the pump 62 is turned on in S12. When the leakage diagnostic device 60 is normal, the first atmospheric passage 31 is blocked, and ventilation is enabled from the canister 23 to the atmospheric opening 33 via the second atmospheric passage 32.

Figure 5:
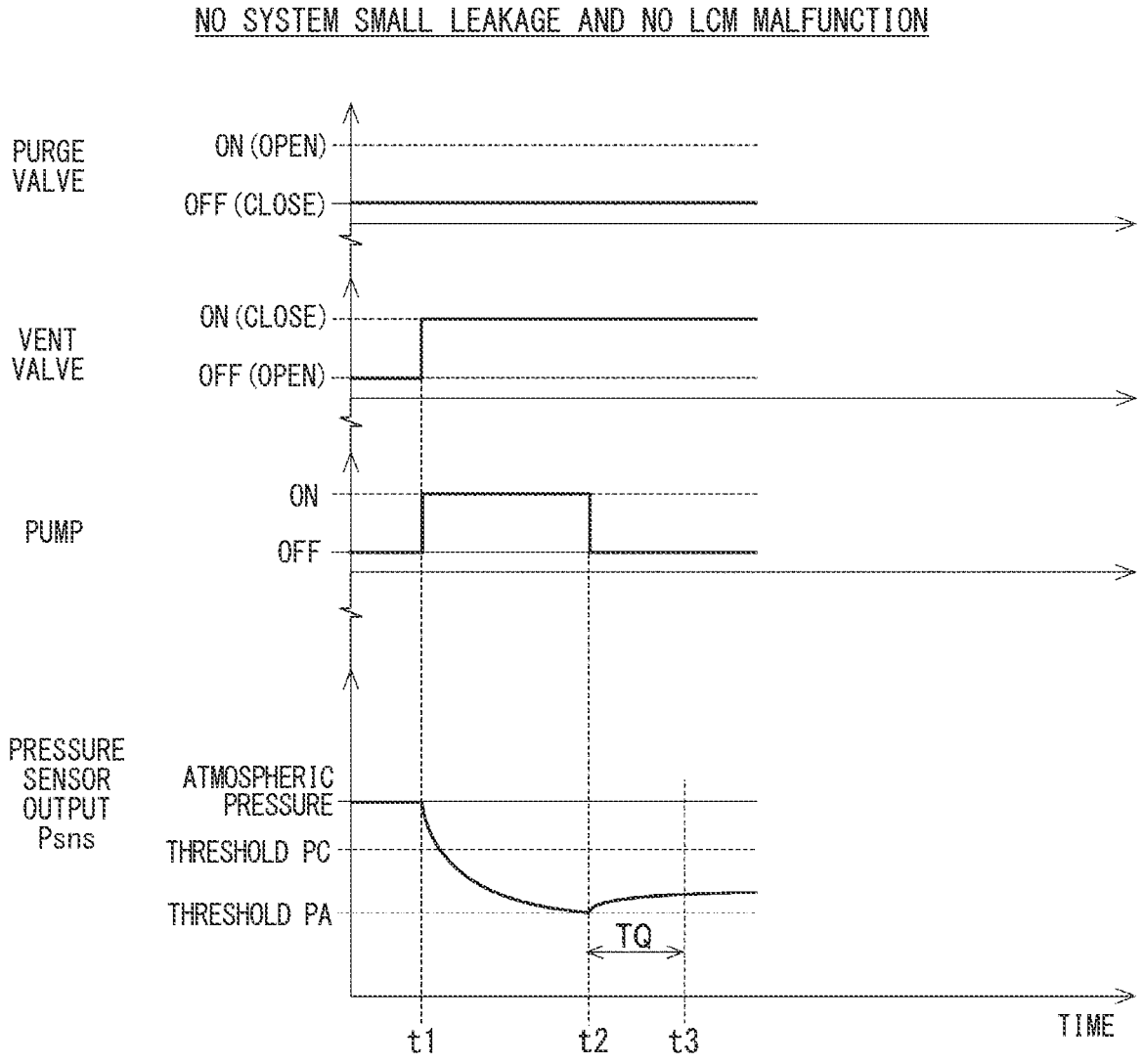
FIG. 5 is a time chart in a case of no system small leakage and no LCM malfunction.
Figure 6:
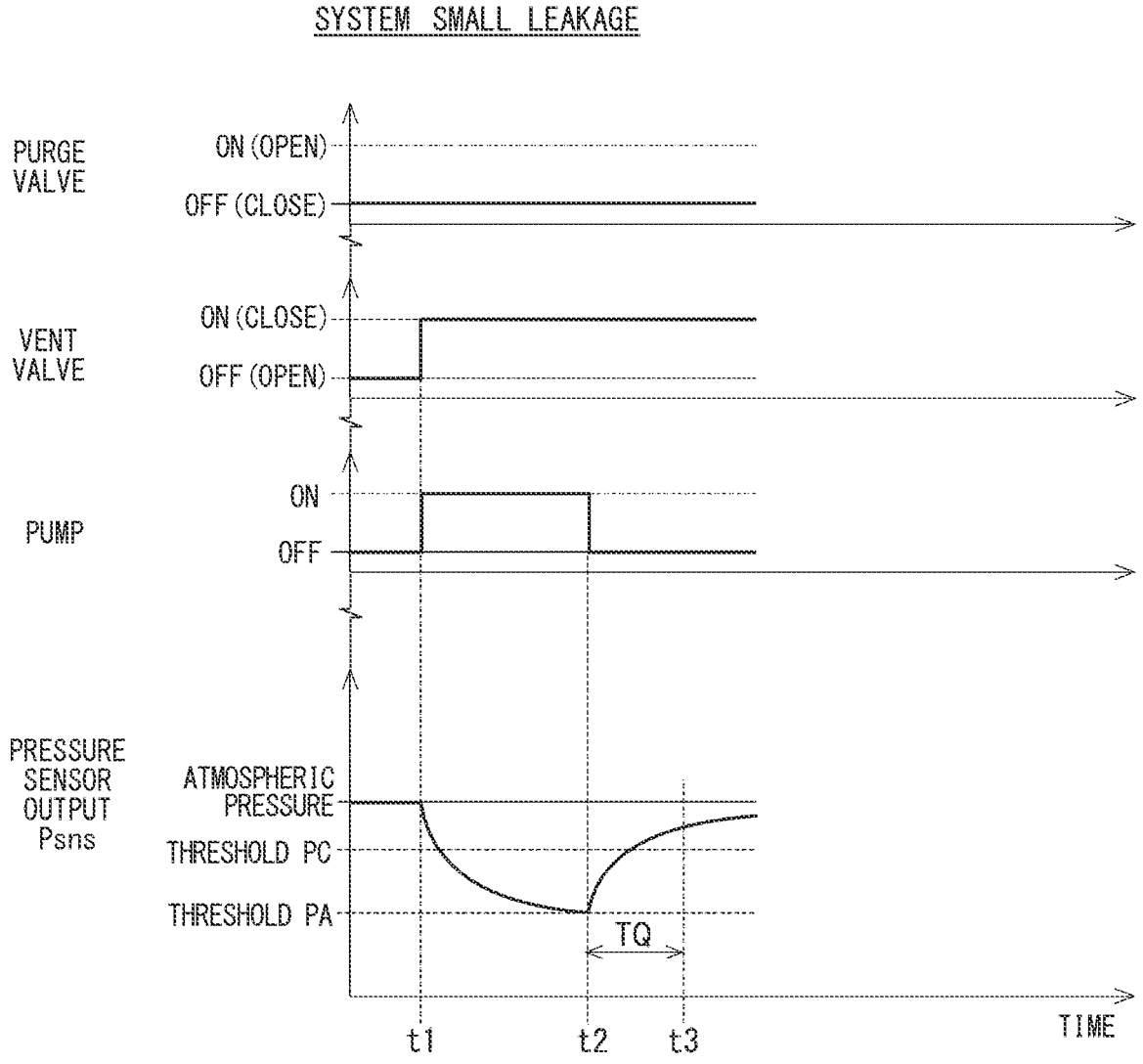
FIG. 6 is a time chart in a case of a system small leak.
Figure 7:
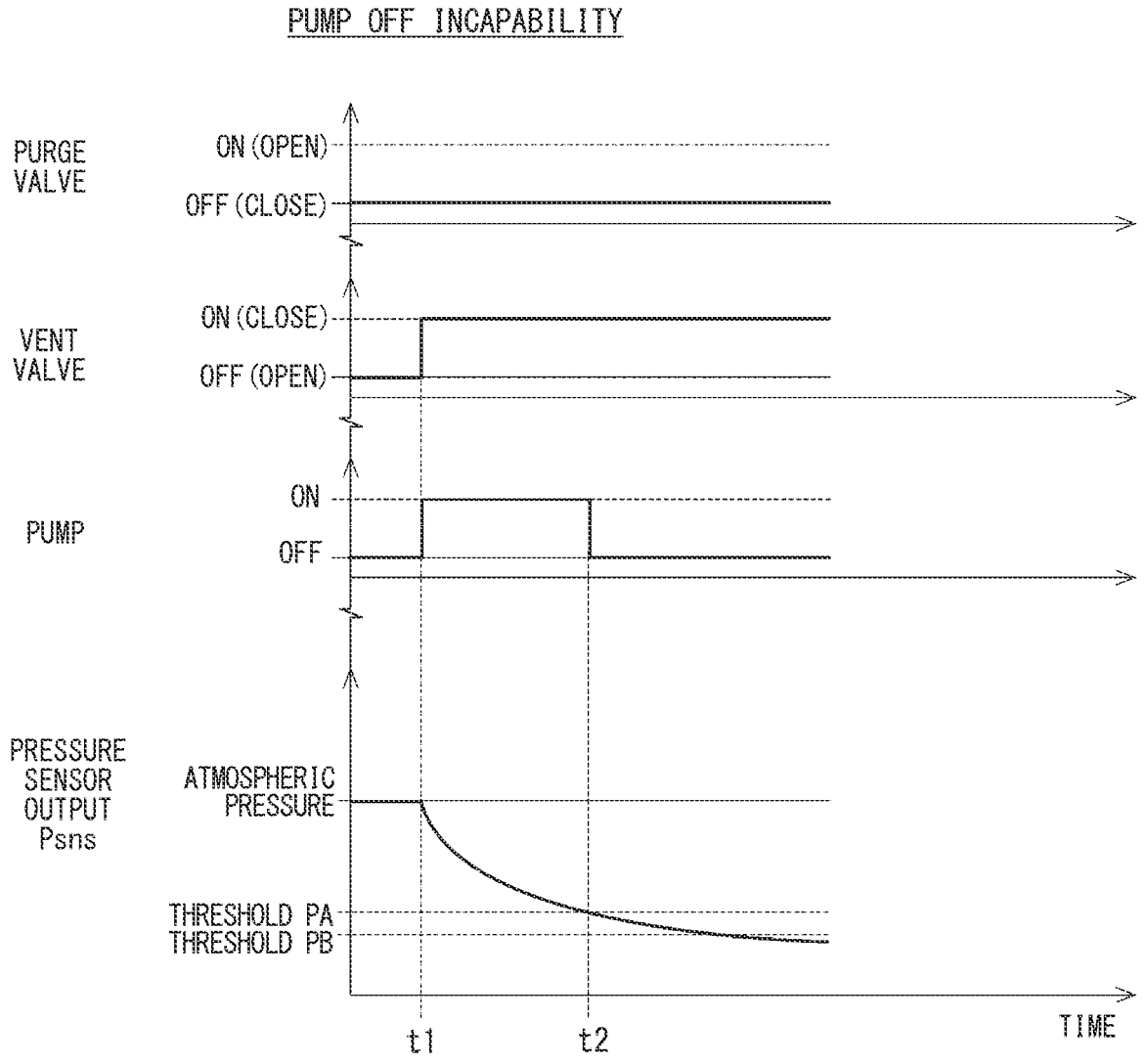
FIG. 7 is a time chart in a case of a pump off incapability.

At time t2, in S13, it is determined whether the pressure sensor output value Psns is equal to or less than the threshold PA. In FIGS. 5 to 7, the pressure sensor output value Psns is equal to or less than the threshold value PA, and determination of YES is made in S13. Thus, the pump 62 is turned off in S14. When NO in S13, it is determined in S60 that "vent valve open stuck, or pump malfunction, or check valve close stuck, or filter clogging, or large leakage in the system" occurs. The process proceeds to FIG. 4. Here, "check valve close stuck" means that at least one of the first check valve 631 and the second check valve 632 is closed and stuck.

In S15 following S14, it is determined whether the pressure sensor output value Psns is equal to or higher than the threshold value PB. When determination of YES is made, the process proceeds to S17. In S14, when the system and the leakage diagnostic device 60 are normal, the second atmospheric passage 32 is blocked, and the pressure in the system is maintained.

In S17, it is determined whether a time for the pressure sensor output value Psns to reach the threshold value PC is larger than a threshold value TQ after the pump 62 is turned off. That is, the pressure sensor output value Psns at time t3 after the threshold TQ elapses from time t2 is compared with the threshold PC.

As shown in FIG. 5, when the pressure sensor output value Psns at time t3 is smaller than the threshold PC, and determination of YES is made in S17, it is determined in S70 that "no small leakage in system and no LCM malfunction" occurs. As shown in FIG. 6, when the pressure sensor output value Psns at time t3 is equal to or higher than the threshold value PC and determination of NO is made in S17, it is determined in S68 that "small leakage in system" occurs.

Returning to S15, as shown in FIG. 7, when the pressure sensor output value Psns continues to decrease and falls below the threshold PB after the pump off command is made, it is determined in S66 that "pump off incapability" occurs.

Figure 4:
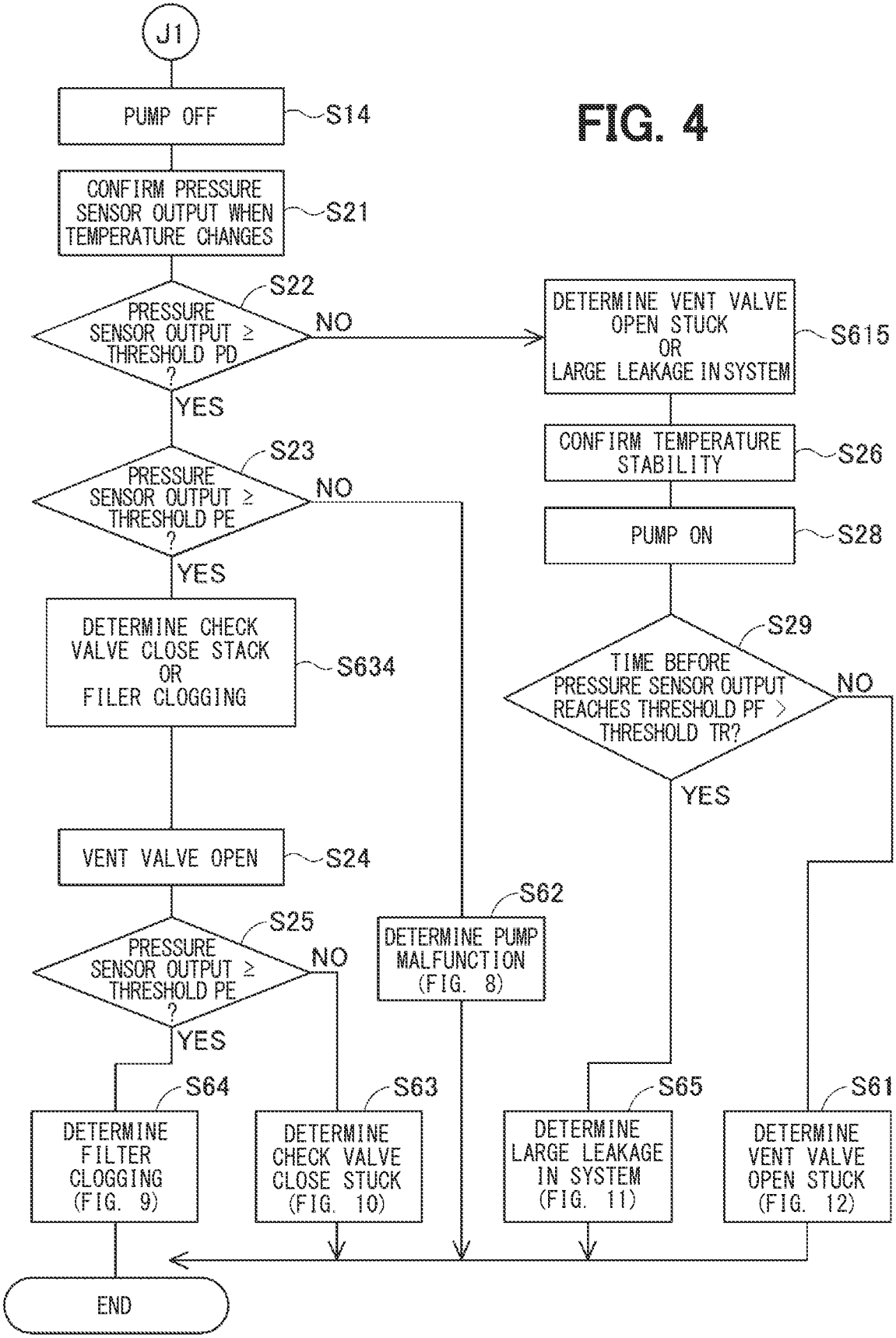
FIG. 4 is a flowchart (2) for the same malfunction diagnosis.

Subsequently, FIG. 4 is referred to. After the determination of NO is made in S13, the pump 62 is turned off in S14. In S21, the pressure sensor output value Psns when the ambient temperature of the leakage diagnostic device 60 changes (here, increases) is confirmed. Here, the system temperature may be positively heated by a heating device or the like. Alternatively, the process may wait for the temperature to increase as the temperature increases in the daytime. When the temperature increases while the system is blocked, the air in the piping expands, and the pressure in the piping increases. Therefore, the pressure sensor output value Psns changes as the system temperature changes.

In FIGS. 8 to 12, the system temperature increases from time t2 to time t6. In S22, it is determined whether the pressure sensor output value Psns after the temperature increase is equal to or higher than the threshold value PD. When the pressure sensor output value Psns is smaller than the threshold value PD, determination of NO is made in S22, and it is determined in S615 that "vent valve open stuck or large leakage in the system" occurs. When determination of YES is made in S22, it is further determined in S23 whether the pressure sensor output value Psns is equal to or larger than the threshold PE. The thresholds PD and PE may be set at a suitable time according to the system temperature after the system temperature increases.

Figure 8:
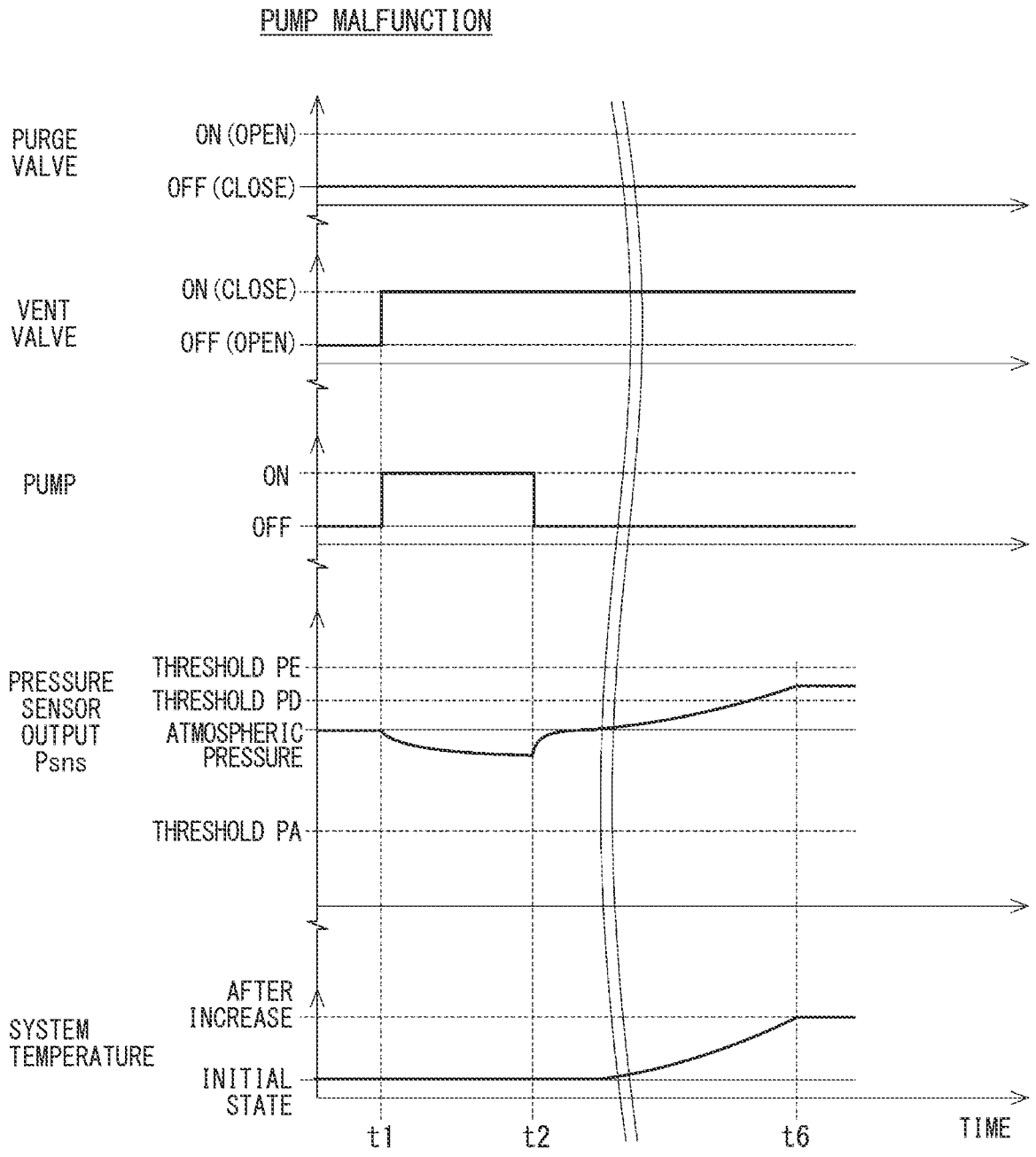
FIG. 8 is a time chart in a case of a pump malfunction.

As shown in FIG. 8, when the pressure sensor output value Psns after the temperature increases is equal to or higher than the threshold value PD and smaller than the threshold value PE, determination of NO is made in S23. In this case, it is presumed that the ventilation of the second atmospheric passage 32 is normal, and the factor of the determination of NO in S13 in S62 is determined to be "pump malfunction" occurs.

Figure 9:
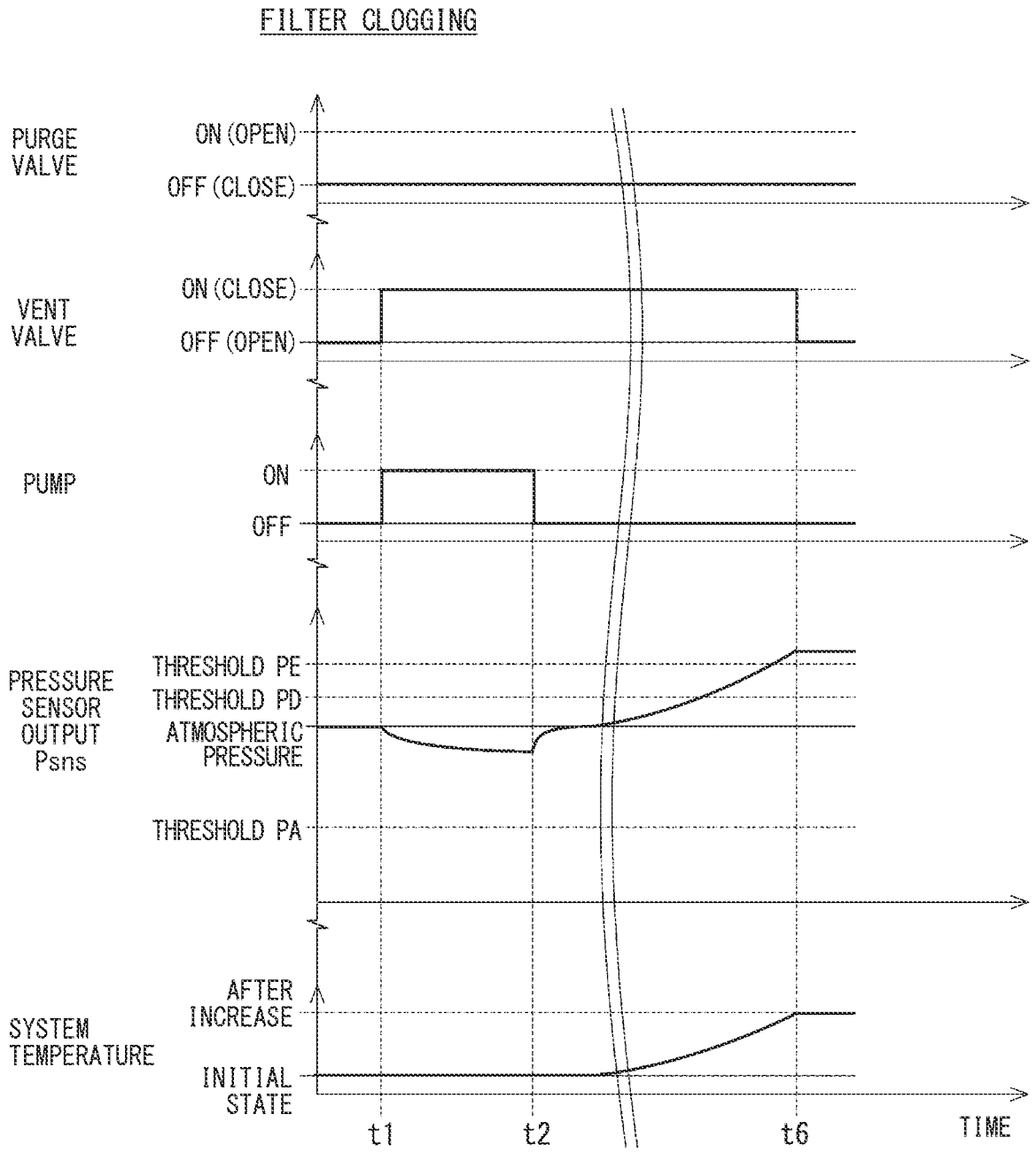
FIG. 9 is a time chart in a case of a filter clogging.
Figure 10:
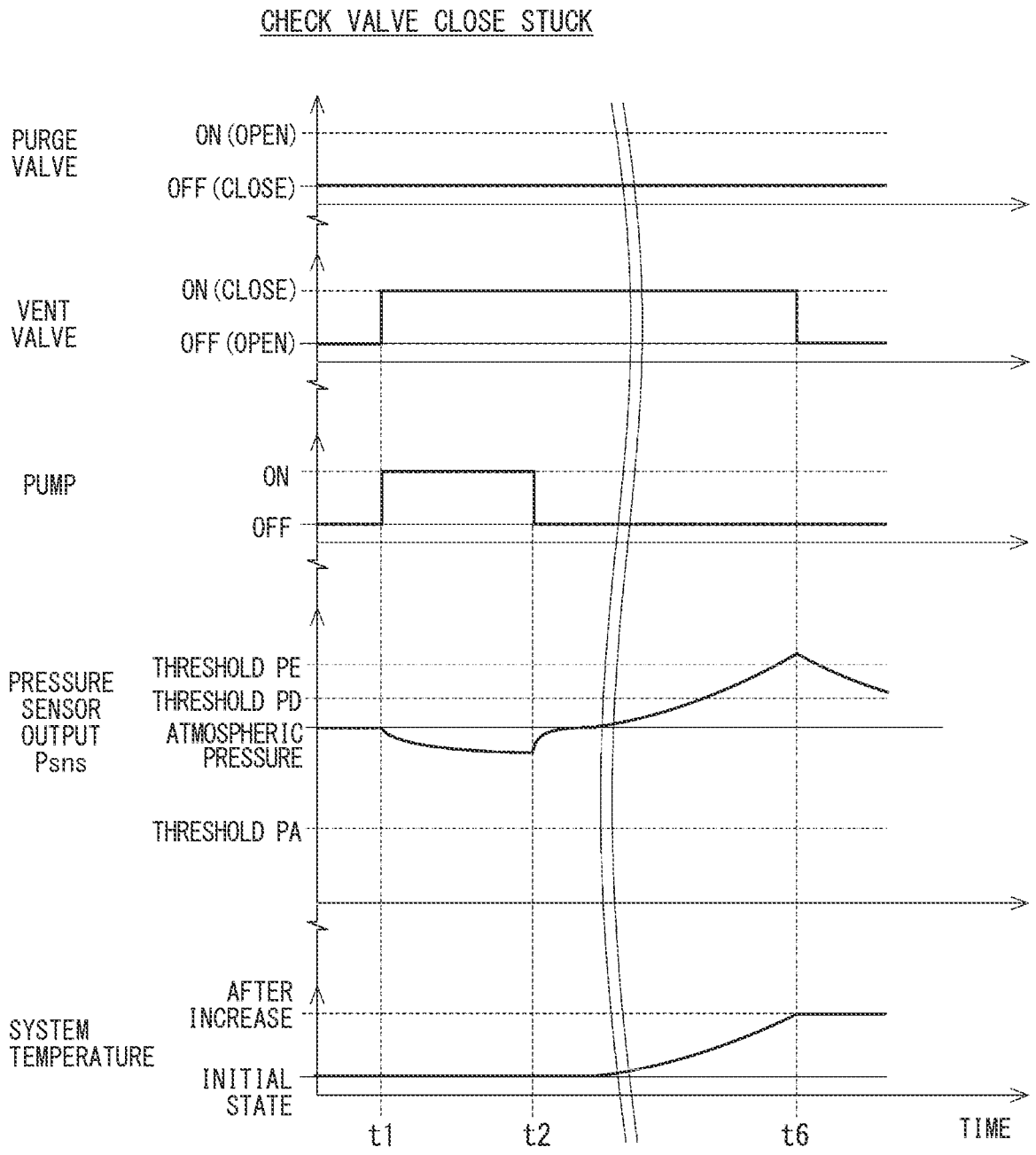
FIG. 10 is a time chart in a case of a check valve close stuck.

When the pressure sensor output value Psns after the temperature increases is equal to or higher than the threshold value PE, determination of YES is made in S23, and it is determined in S634 that "check valve close stuck or filter clogging" occurs. Then, at time t6, the vent valve 61 is opened at S24, and at S25, it is determined again whether the pressure sensor output value Psns is equal to or higher than the threshold value PE. As shown in FIG. 9, when determination of YES is made in S25, it is determined in S64 that "filter clogging" occurs. As shown in FIG. 10, when the vent valve 61 is opened and when the pressure sensor output value Psns is lower than the threshold value PE, determination of NO is made in S25, and it is determined in S63 that "check valve close stuck" occurs.

On the other hand, in S26 following S615, after the stability of the system temperature is confirmed, the pump 62 is turned on in S28 at time t7. In S29, it is determined whether a time for the pressure sensor output value Psns to reach the threshold value PF is larger than the threshold value TR after the pump 62 is turned on. That is, the pressure sensor output value Psns at time t8 after the threshold TR elapses from time t7 is compared with the threshold PF.

Figure 11:
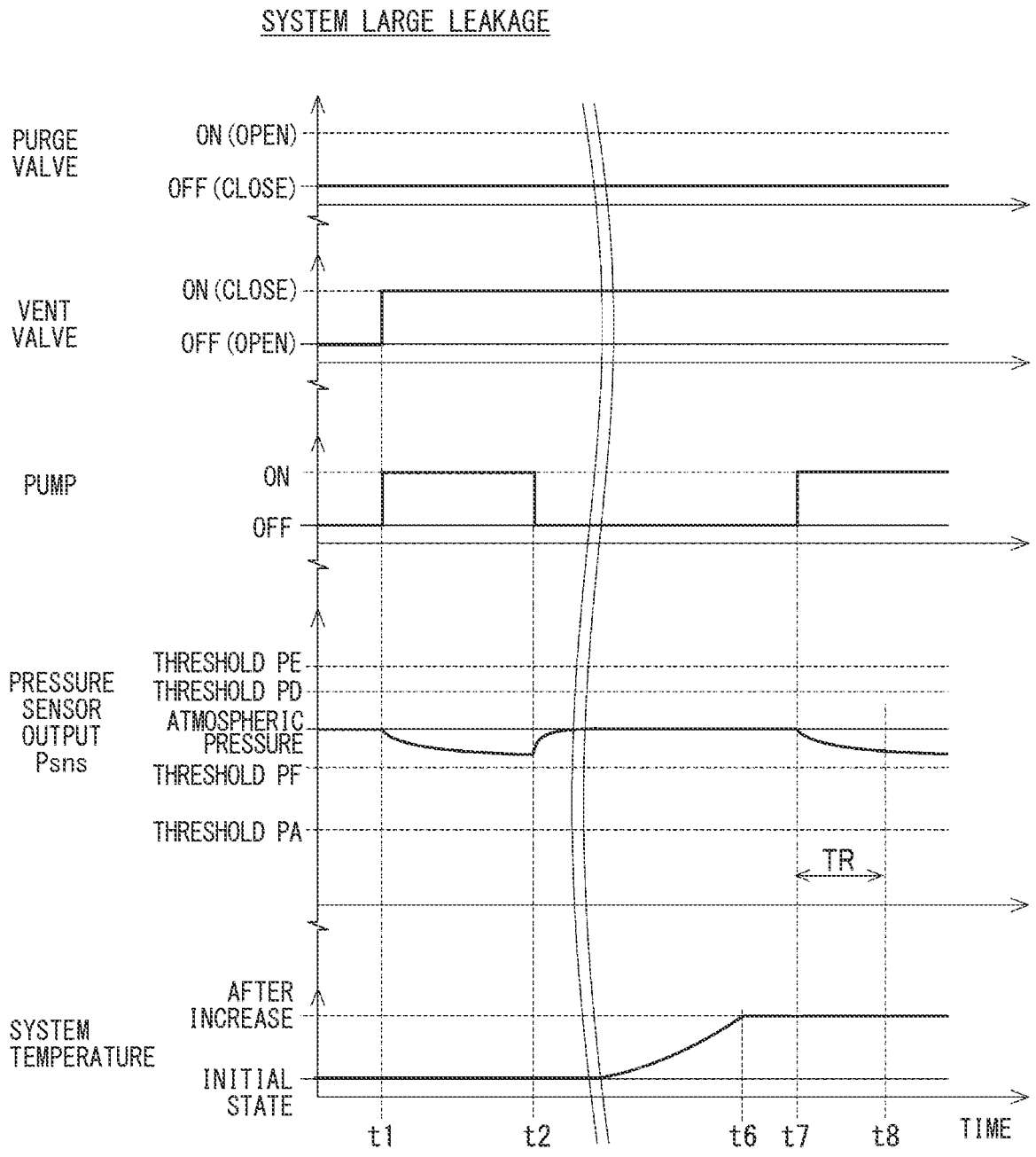
FIG. 11 is a time chart in a case of a system large leak.

As shown in FIG. 11, when the pressure sensor output value Psns at time t8 is larger than the threshold value PF, determination of YES is made in S29, and it is determined in S65 that "large leakage in system" occurs. When large leakage occurs in the system, the pump 62 draws gas containing the evaporative fuel. Therefore, the pump load becomes larger than the case where the pump 62 draws gas that does not contain the evaporated fuel. Thus, it takes a long time to reduce the pressure in the piping to the threshold value PF.

Figure 12:
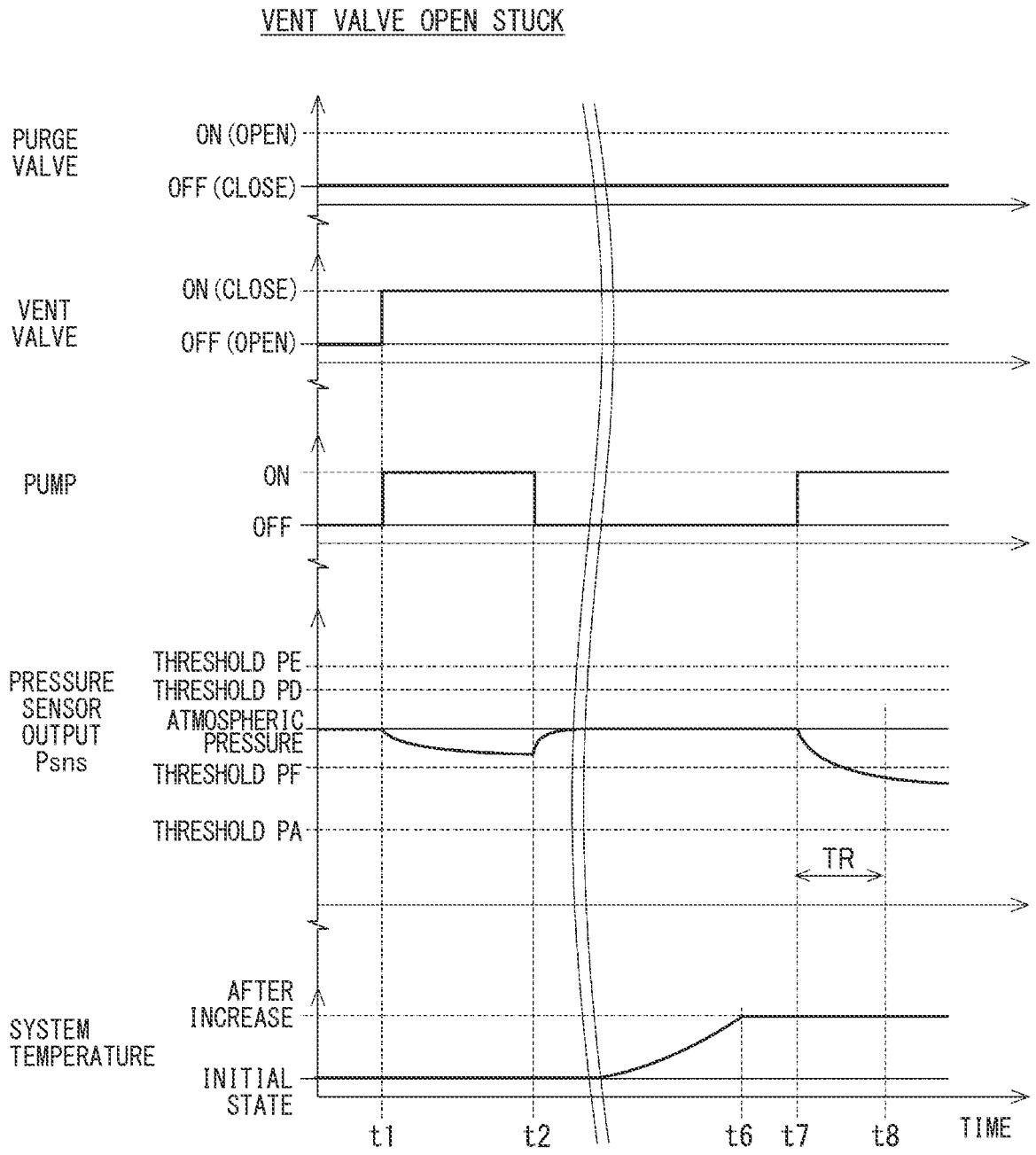
FIG. 12 is a time chart in a case of a vent valve open stuck.
Figure 13:
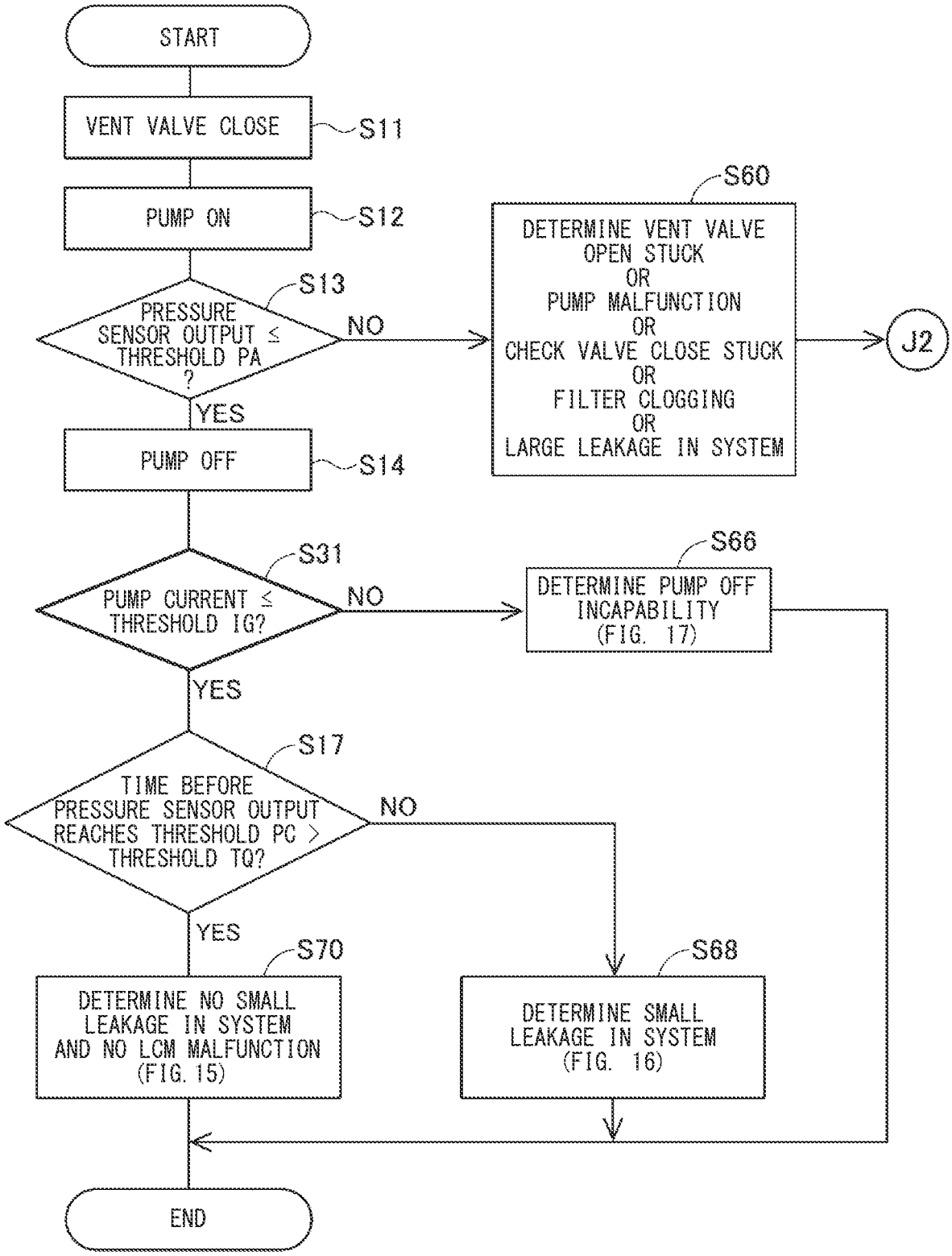
FIG. 13 is a flowchart (1) showing a malfunction diagnosis implemented by a malfunction diagnostic device of a second embodiment.

As shown in FIG. 12, when the pressure sensor output value Psns at time t8 is equal to or less than the threshold value PF, determination of NO is made in S29, and it is determined in S61 that "vent valve open stuck" occurs. In the case where open suck of the vent valve 61 occurs, the pump 62 draws gas that does not contain evaporated fuel. Therefore, the pump load is small, and the time for the pressure in the pipe to decrease to the threshold value PF is short.

As described above, the malfunction diagnosis of the first embodiment includes the step of evaluating the pressure sensor output value Psns with the vent valve 61 that is closed and the pump 62 that is turned on. S13 corresponds to this step. Herein, as a specific method for evaluating the pressure sensor output value Psns, the pressure sensor output value Psns is compared with the predetermined pressure threshold.

Further, the malfunction diagnosis of the first embodiment further includes the step of evaluating the change in the pressure sensor output value Psns immediately after the pump 62, which is turned on, is turned off with the vent valve 61 that is closed. S17 corresponds to this step. Here, as a specific method for evaluating the change in the pressure sensor output value Psns, the time for the pressure sensor output value Psns to reach the predetermined pressure threshold is compared with the predetermined time threshold.

The malfunction diagnosis of the first embodiment further includes the step of evaluating the change in the pressure sensor output value Psns immediately after the pump 62, which is turned off, is turned on with the vent valve 61 that is closed. S29 corresponds to this step. The specific method for evaluating the change in the pressure sensor output value Psns is similar to the method described above.

The malfunction diagnosis of the first embodiment further includes the step of evaluating the pressure sensor output value Psns when the ambient temperature of the leakage diagnostic device 60 changes with the vent valve 61 that is closed and the pump 62 that is turned off. A22 and S23 correspond to this step.

The malfunction diagnostic device 80 of the first embodiment is configured to perform various types of malfunction diagnosis of the leakage diagnostic device 60 by combining the above steps. Therefore, the malfunction diagnostic device 80 is capable of appropriately discriminating between the leakage of the evaporative fuel treatment device 10 and the malfunction of the leakage diagnostic device 60.

Second Embodiment

The malfunction diagnosis of the second embodiment will be described with reference to FIGS. 13 to 22. The description of the overlapping portion with the first embodiment will be omitted as appropriate. S11 to S14 are the same as those in the first embodiment. When the pump 62 is turned on at time t1 to t2, when the leakage diagnostic device 60 is normal, the pump current Impump becomes a reference value I0. The pump current thresholds have the following relationship of "IH>I0>IG (>0)" and "IK>IL>I0>IM".

Figure 15:
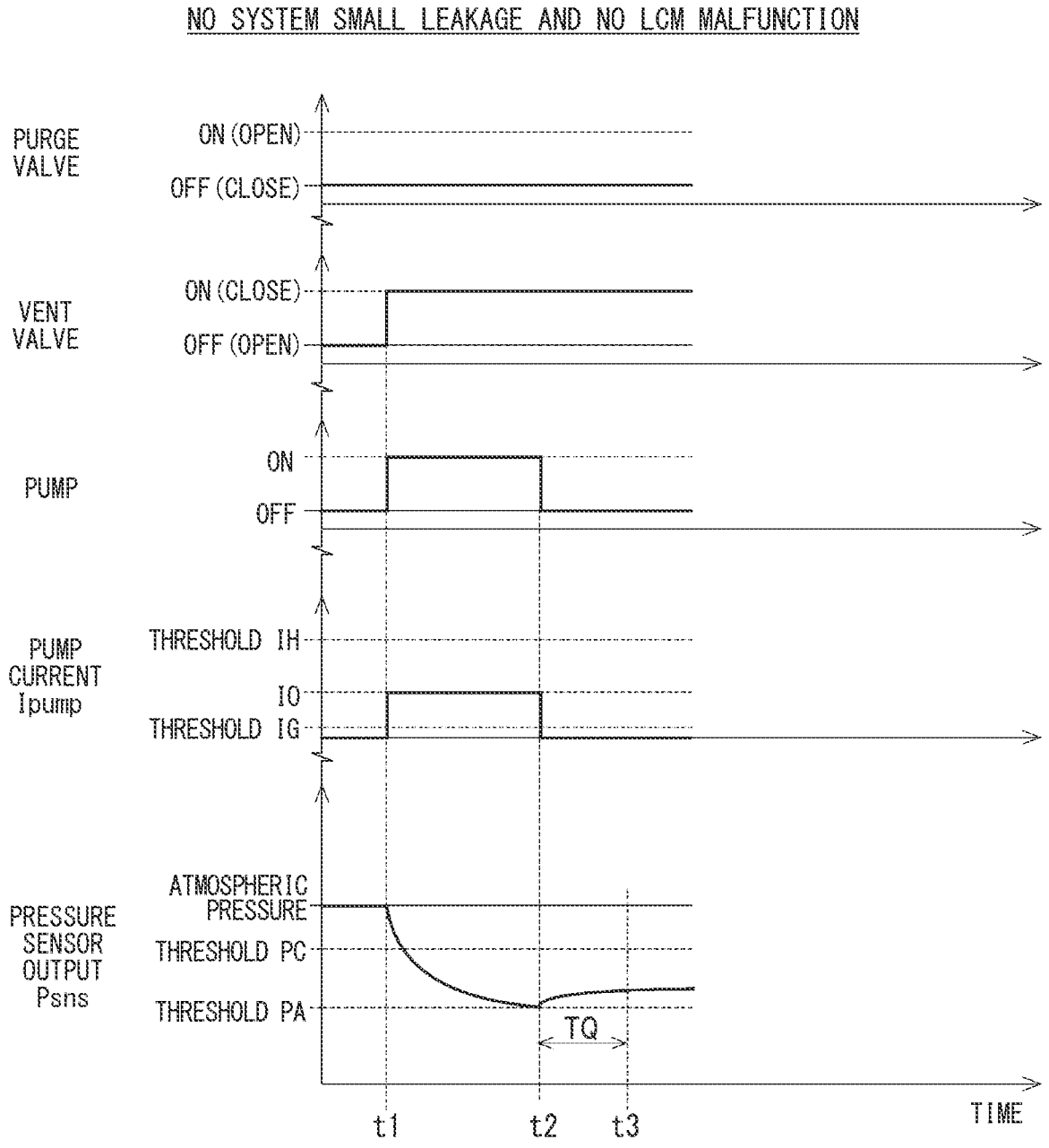
FIG. 15 is a time chart in a case of no system small leakage and no LCM malfunction.
Figure 16:
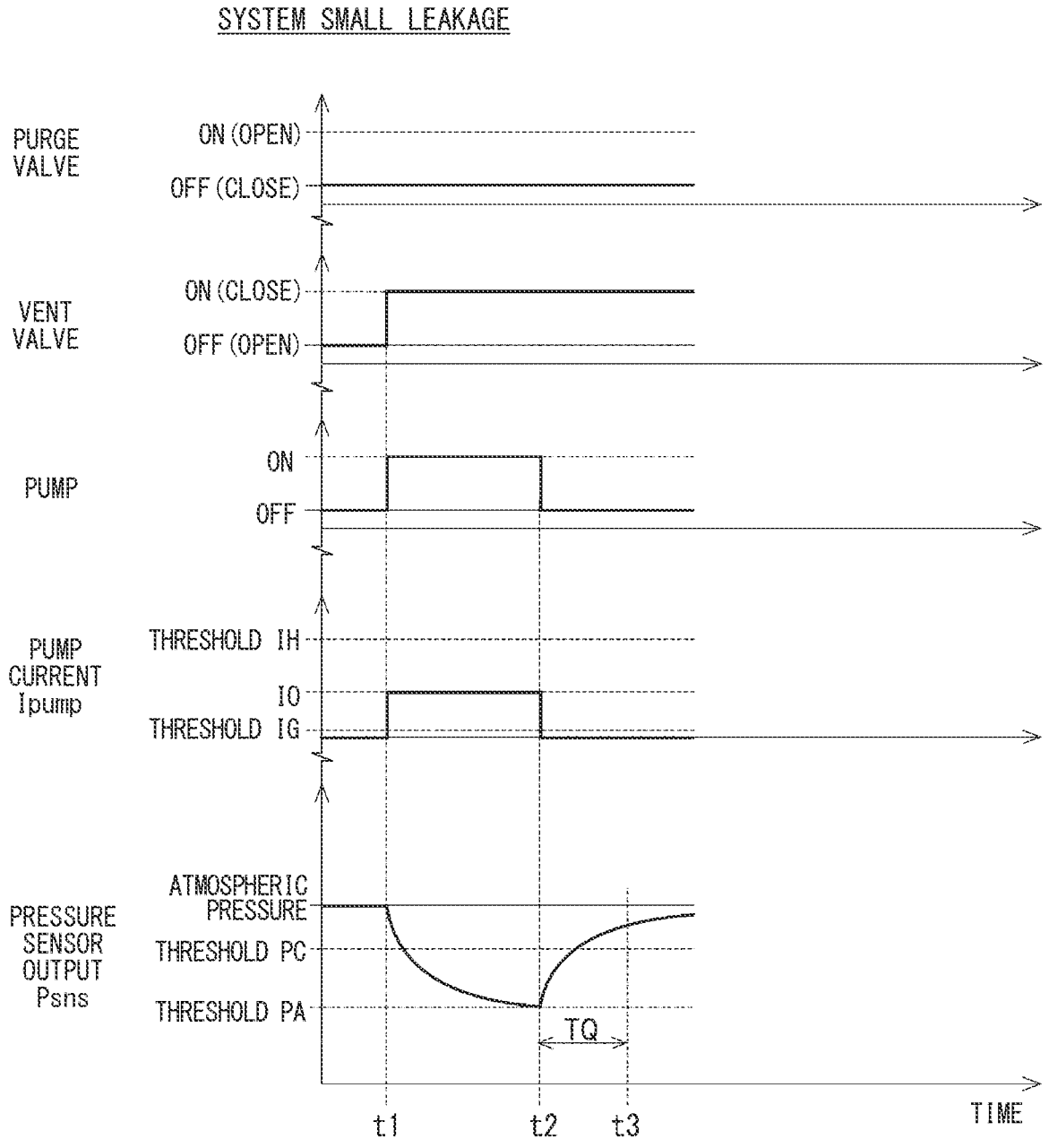
FIG. 16 is a time chart in a case of a system small leak.

After the pump 62 is turned off in S14, it is determined in S31 whether the pump current Impump is equal to or less than the threshold value IG that is a small value close to 0. When determination of YES is made in S31, the process proceeds to S17, and thereafter, the same process as in the first embodiment is executed. As shown in FIG. 15, when determination of YES is made in S17, it is determined in S70 that "no small leakage in the system and no LCM malfunction" occurs. As shown in FIG. 16, when determination of NO is made in S17, it is determined in S68 that "small leakage in system" occurs.

Figure 17:
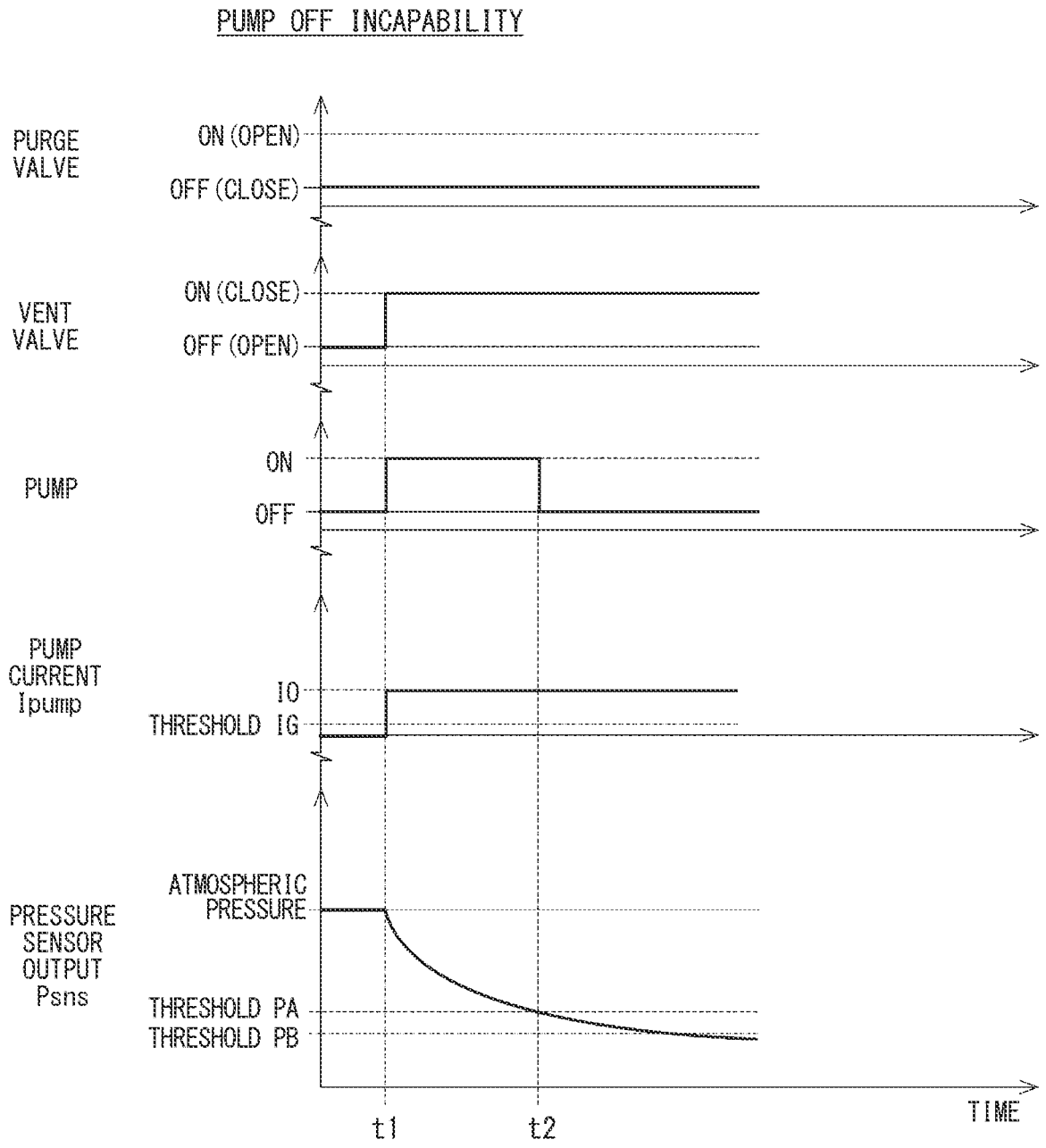
FIG. 17 is a time chart in a case of a pump off incapability.

Returning to S31, as shown in FIG. 17, when the pump current Impump is larger than the threshold value IG after the pump off command is made, determination of NO is made in S31, and it is determined in S66 that "pump off incapability" occurs.

Figure 14:
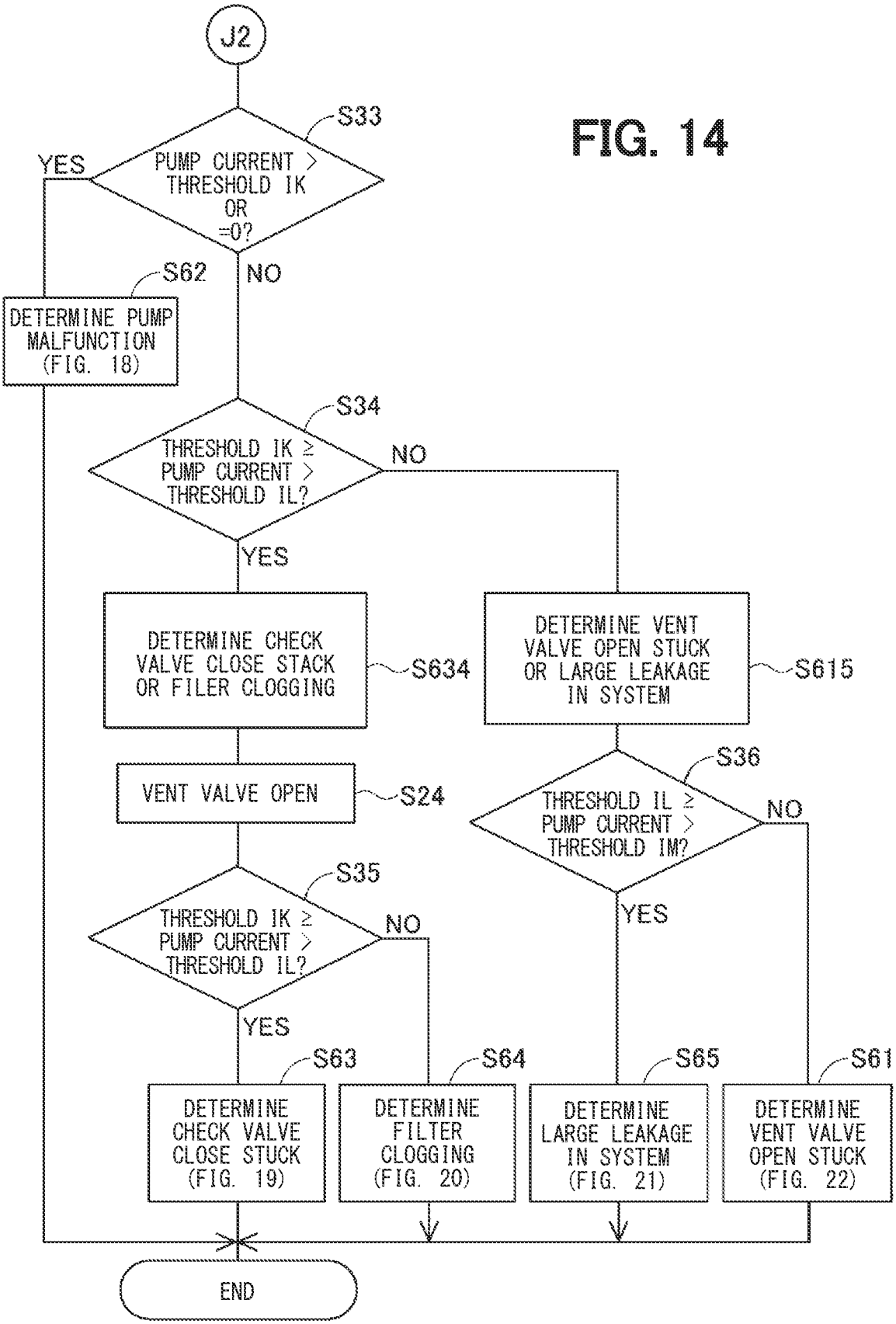
FIG. 14 is a flowchart (2) for the same malfunction diagnosis.
Figure 18:
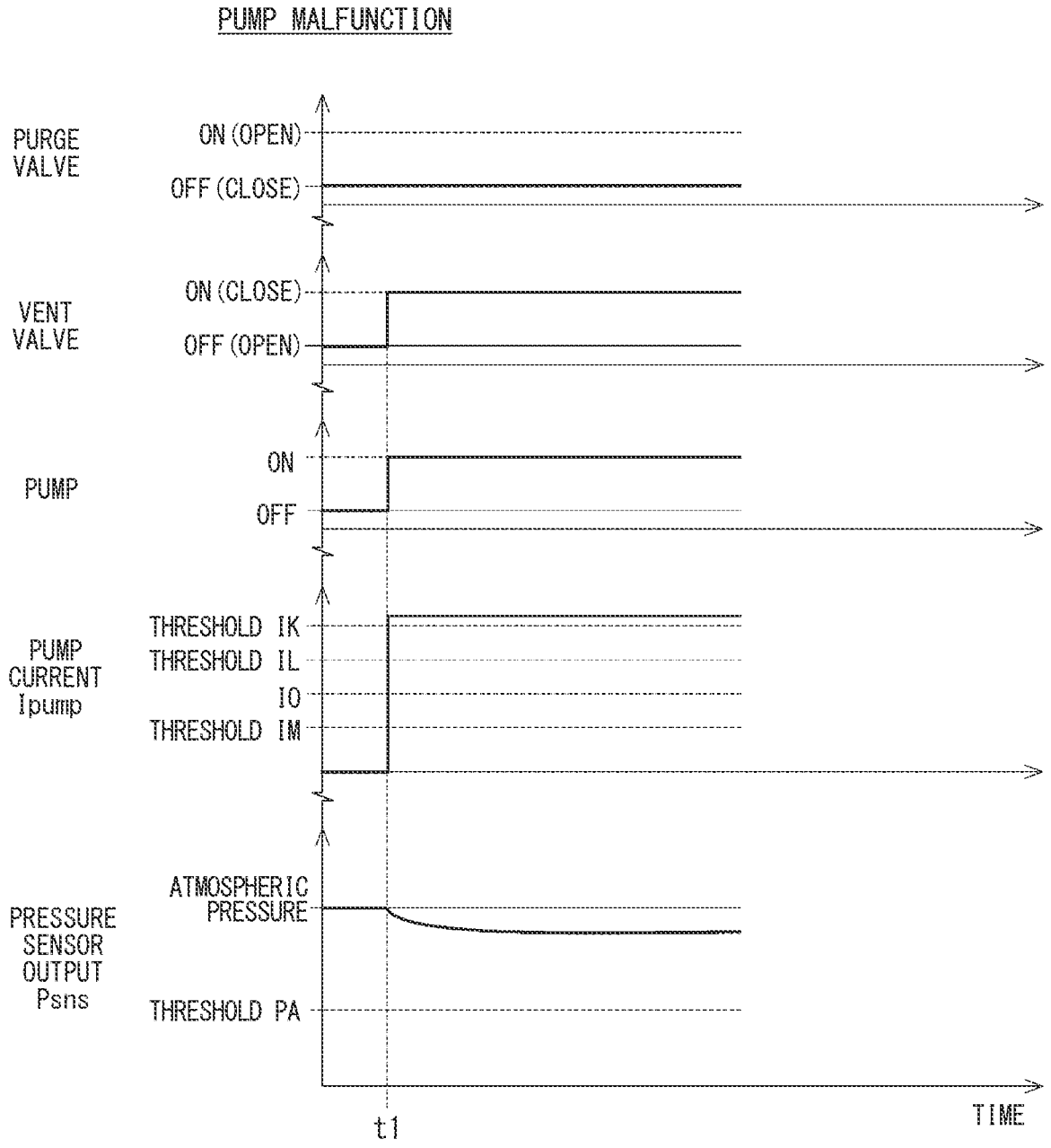
FIG. 18 is a time chart in a case of a pump malfunction.

Subsequently, FIG. 14 is referred to. After determination of NO is made in S13, in S33 it is determined whether the pump current Imp is larger than or equal to the threshold IK. As shown in FIG. 18, when determination of YES is made in S33, it is determined in S62 that "pump malfunction" occurs.

When determination of NO is made in S33, it is determined in S34 whether the pump current Imp is larger than the threshold IL and is equal to or less than the threshold IK. When determination of YES is made in S34, it is determined in S634 that "check valve close stack or filter clogging" occurs. When determination of NO is made in S34, it is determined in S615 that "vent valve open stuck or large leakage in system" occurs.

Figure 19:
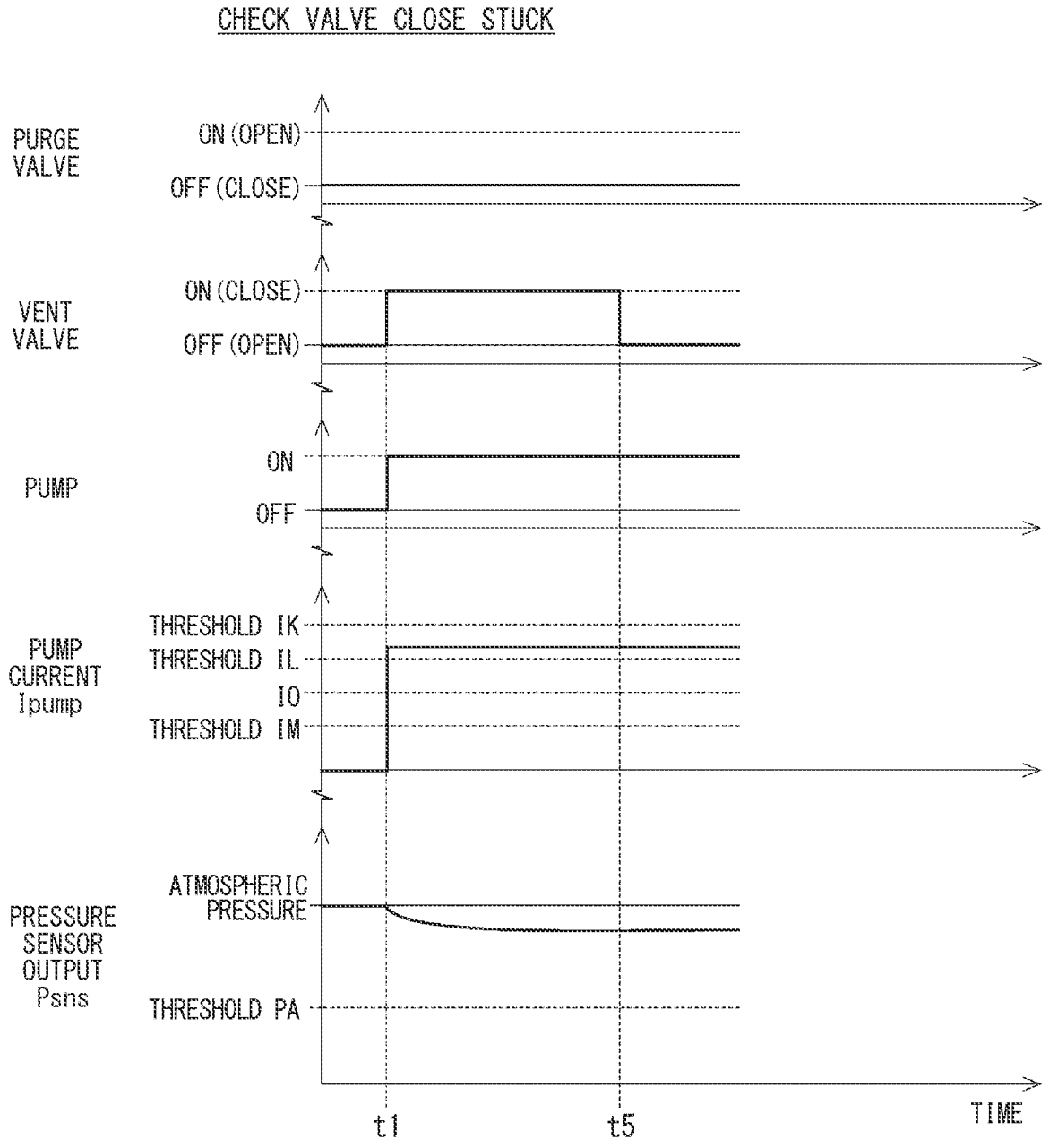
FIG. 19 is a time chart in a case of a check valve close stuck.
Figure 20:
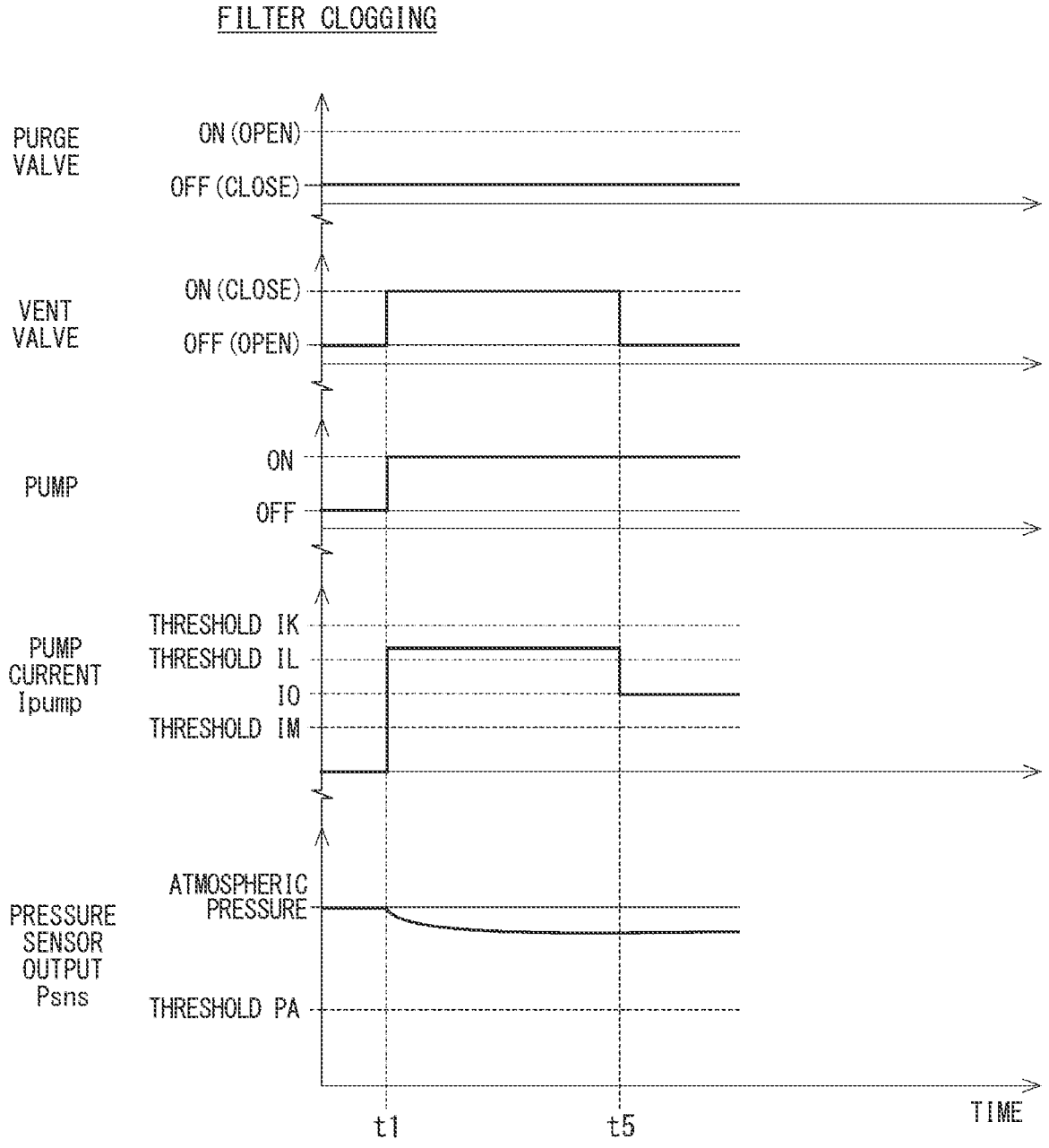
FIG. 20 is a time chart in a case of a filter clogging.

Following S634, the vent valve 61 is opened at time t5 in S24. It is determined in S35 whether the pump current Impump is larger than the threshold IL and is equal to or less than the threshold IK. As shown in FIG. 19, the pump current Imp does not change even when the vent valve 61 is opened, determination of YES is made in S35. Subsequently, it is determined in S63 that "check valve close stuck" occurs. As shown in FIG. 20, when the pump current Impump decreases below the threshold value IL after the vent valve 61 is opened, determination of NO is made in S35. Subsequently, it is determined in S64 that "filter dogging" occurs.

Figure 21:
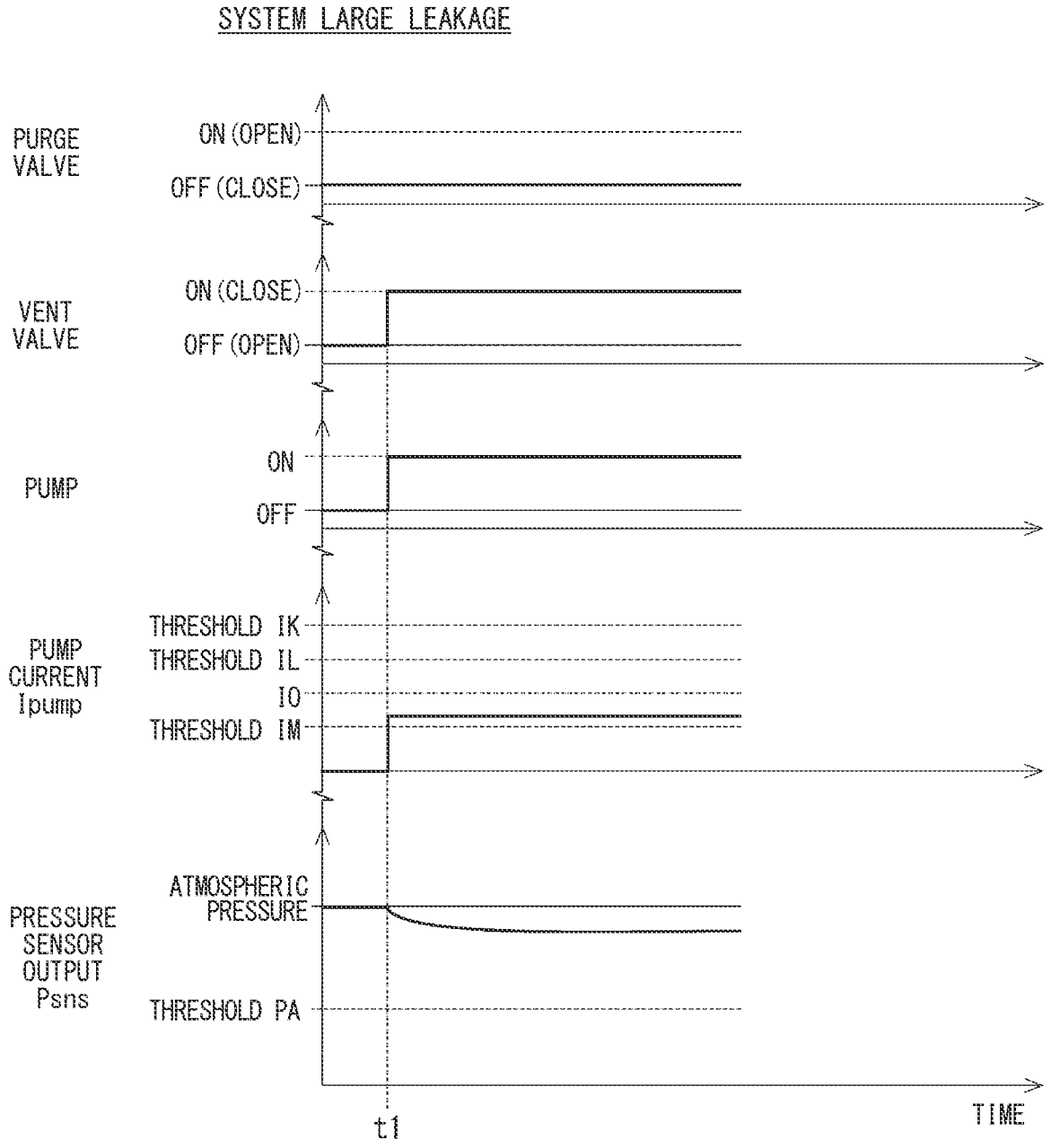
FIG. 21 is a time chart in a case of a system large leak.
Figure 22:
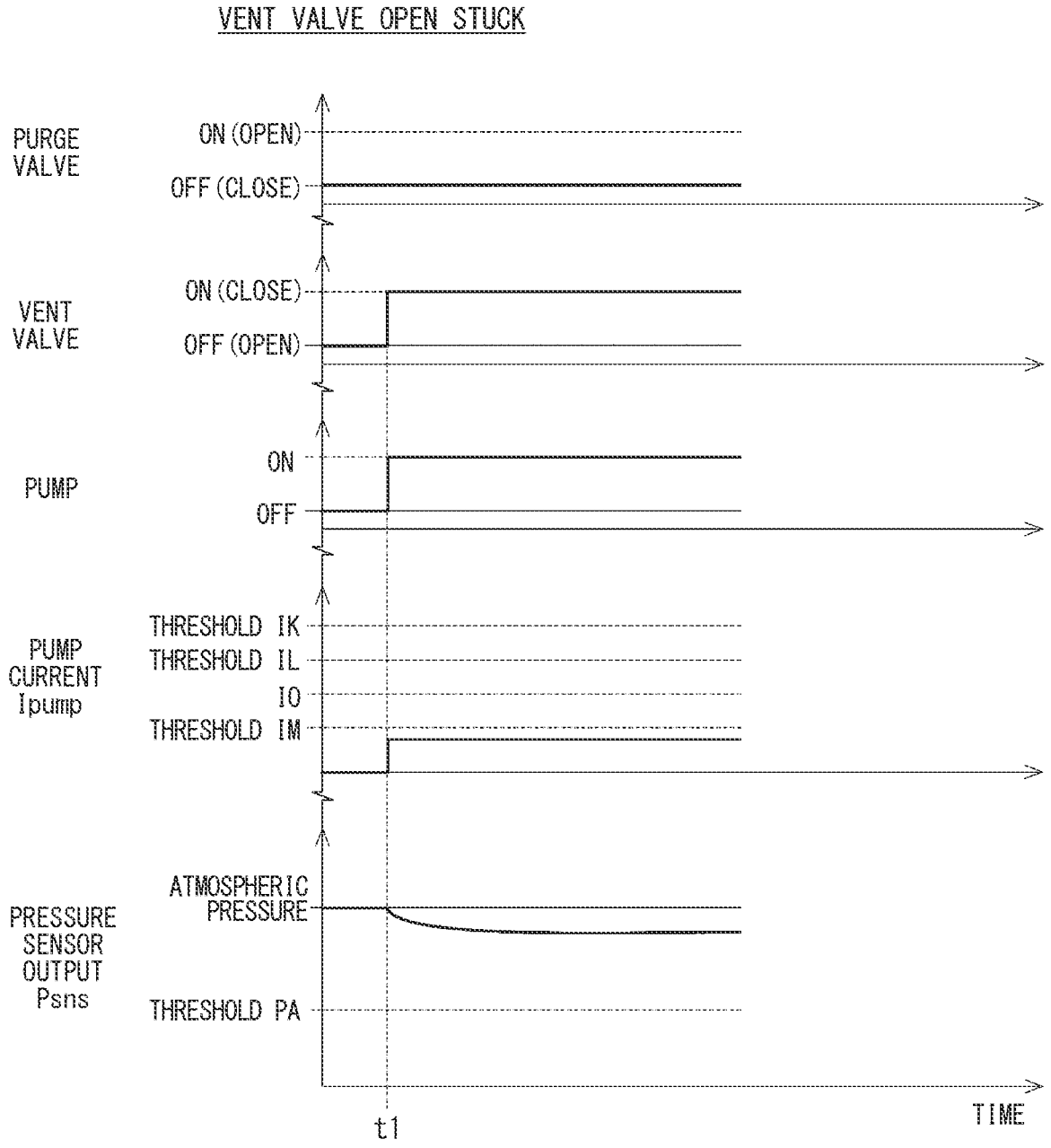
FIG. 22 is a time chart in a case of a vent valve open stuck.
Figure 23:
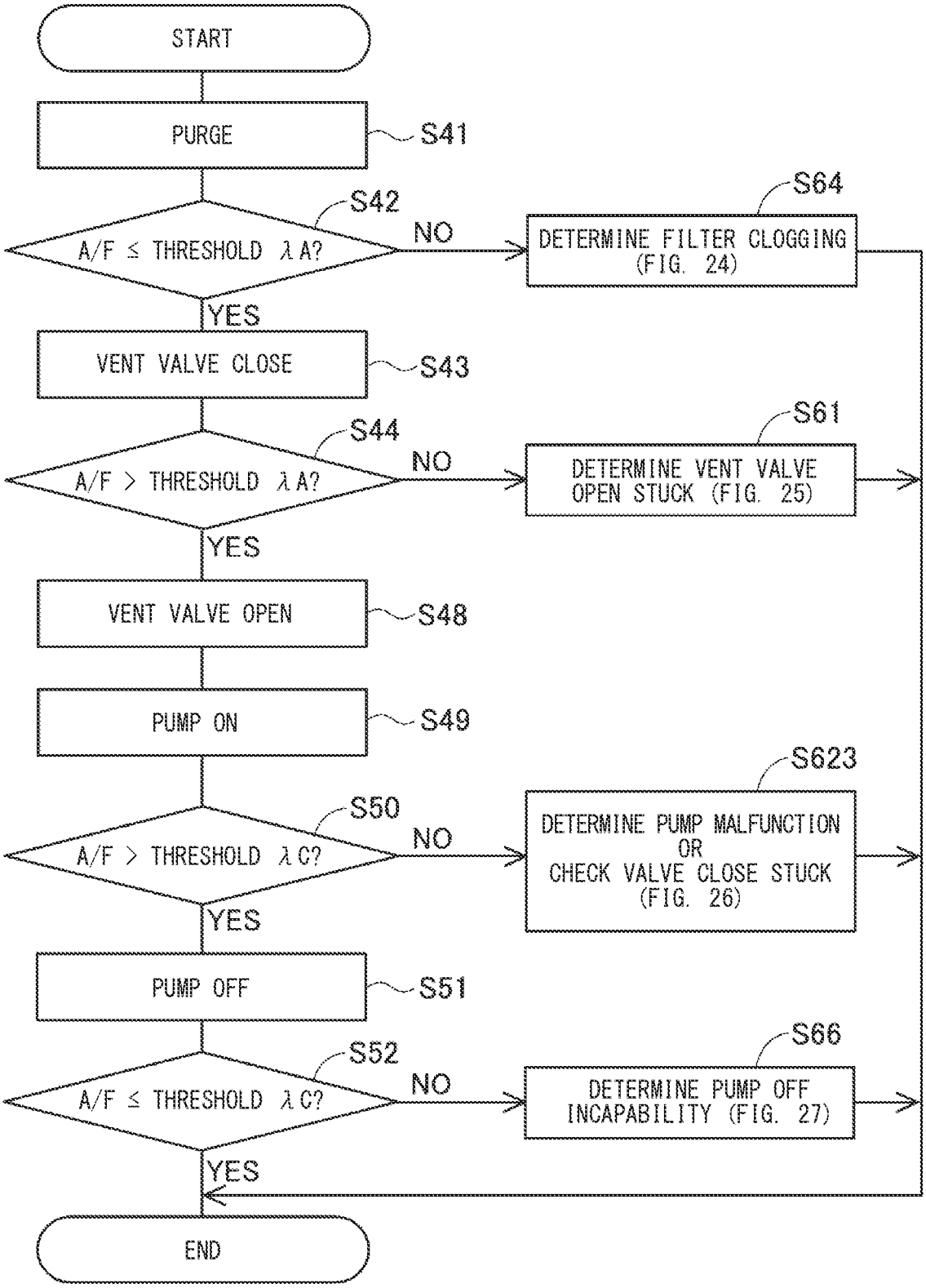
FIG. 23 is a flowchart showing a malfunction diagnosis implemented by a malfunction diagnostic device of a third embodiment.

Following S615, it is determined in S36 whether the pump current Imp is larger than the threshold IM and is equal to or less than the threshold IL. As shown in FIG. 21, when determination of YES is made in S36, it is determined in S65 that "large leakage in system" occurs. As shown in FIG. 22, when the pump current Impump is equal to or less than the threshold value IM, determination of NO is made in S36. Subsequently, it is determined in S61 that "vent valve open stuck" occurs.

As described above, the malfunction diagnostic device 80 of the second embodiment diagnoses at least the malfunction of the pump 62 in the malfunction diagnosis based on the pump current Imp in the state where the vent valve 61 is closed and where the pump 62 is turned on or where the pump 62, which is turned on, is turned off. S33, S34, S35, and S36 correspond to the malfunction diagnosis in the "state where the pump 62 is turned on", and S31 corresponds to the malfunction diagnosis in the "state where the pump 62, which is turned on, is turned off".

Further, the malfunction diagnostic device 80 of the second embodiment performs the malfunction diagnosis by combining determinations based on the pressure sensor output value Psns in the malfunction diagnosis. In this way, the malfunction diagnostic device 80 is capable of performing various types of malfunction diagnosis of the leakage diagnostic device 60. Therefore, the malfunction diagnostic device 80 is capable of appropriately discriminating between the leakage of the evaporative fuel treatment device 10 and the malfunction of the leakage diagnostic device 60.

Third Embodiment

The malfunction diagnosis of the third embodiment will be described with reference to FIGS. 23 to 26. The malfunction diagnostic device 80 of the third embodiment performs the malfunction diagnosis based on the output value of the air-fuel ratio sensor 15 with the purge valve 42 that is opened to purge the evaporated fuel from the canister 23 to the intake passage 45 in the malfunction diagnosis. In the third embodiment, unlike the first and second embodiments, the leakage diagnosis of the system is not performed at the same time, and only the malfunction diagnosis of the leakage diagnostic device 60 is performed. Then, after it is confirmed that the leakage diagnostic device 60 has no malfunction, the leakage diagnosis of the system using the leakage diagnostic device 60 is performed again.

On the horizontal axis of the time chart of the third embodiment, τ1 to τ4 are used as time symbols to distinguish the time symbols from those in the first and second embodiments. The ellipse shown by the alternate long and short dash line in the drawing indicates a point of interest. Air-fuel ratio thresholds have a relationship of "λA>λC>14.7 (ideal value)".

Figure 24:
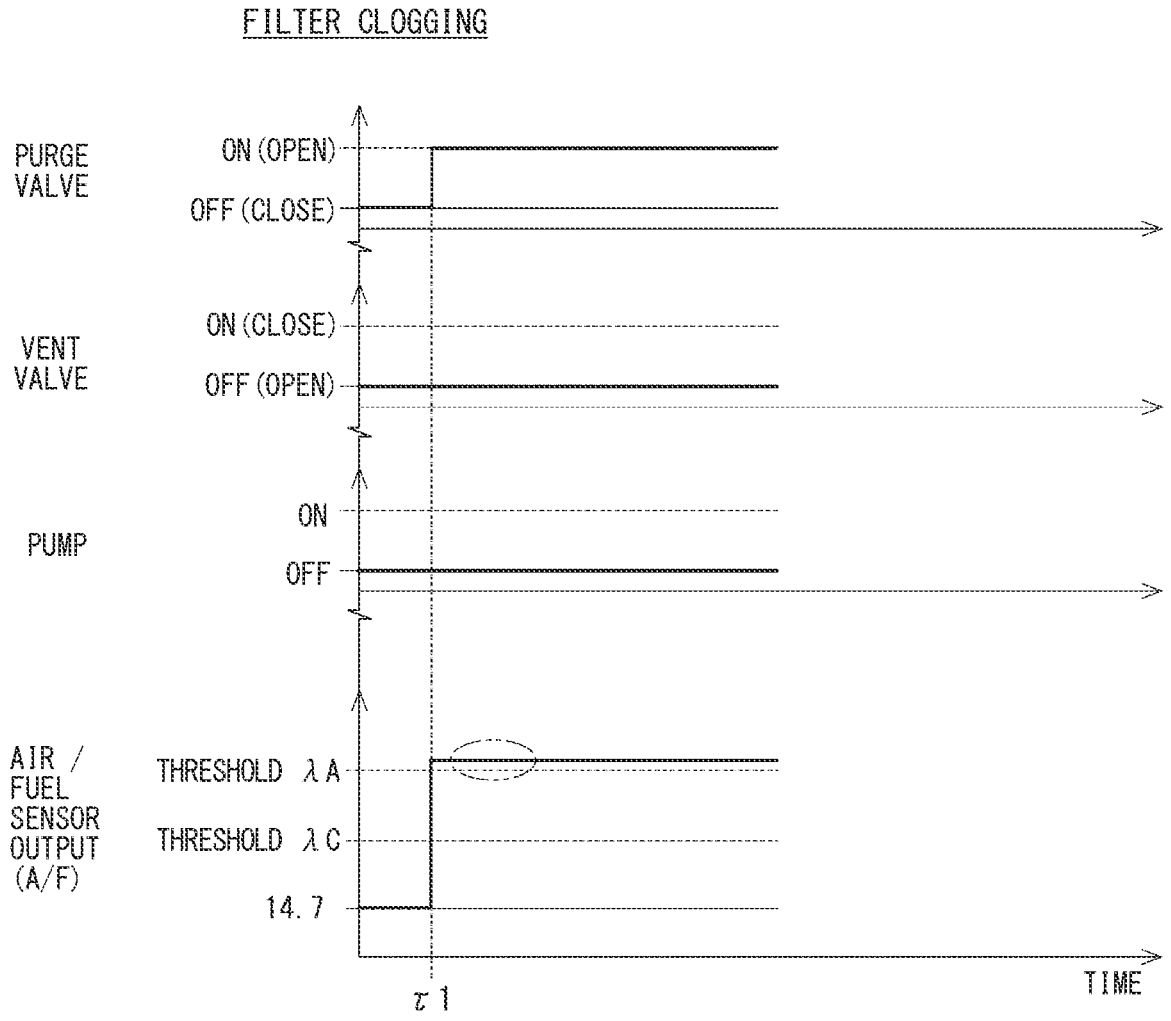
FIG. 24 is a time chart in a case of a filter clogging.

At time τ1, the purge valve 42 is opened in S41, and the purge is performed. When the passage from the atmospheric opening 33 to the purge valve 42 is capable of normally ventilating air therethrough, the evaporated fuel is introduced into the intake passage 45 when the purge is started, and the air-fuel ratio A/F of the air-fuel mixture becomes an ideal value of 14.7. When the passage is blocked, the evaporated fuel is hardly introduced into the intake passage 45. Therefore, the air-fuel mixture becomes lean, and the air-fuel ratio A/F becomes a value larger than the ideal value of 14.7. In S42, it is determined whether the air-fuel ratio sensor output value A/F is equal to or less than the threshold value λA. As shown in FIG. 24, when the air-fuel ratio sensor output value A/F is larger than the threshold value λA, determination of NO is made in S42. Subsequently, it is determined in S64 that "filter clogging" occurs.

Figure 25:
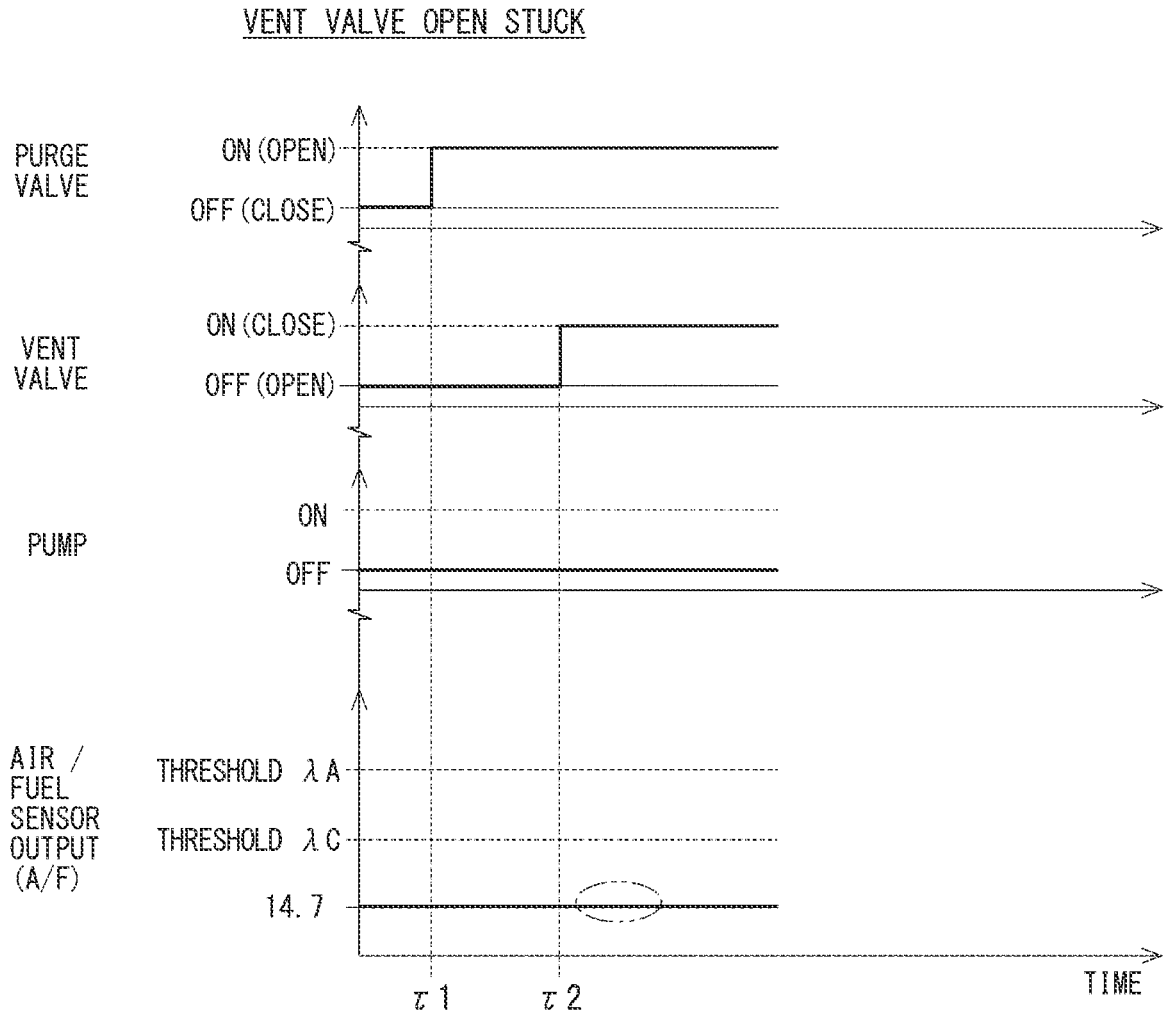
FIG. 25 is a time chart in a case of a vent valve open stuck.

When determination of YES is made in S42, the vent valve 61 is closed in S43 at time τ2. Subsequently, it is determined in S44 whether the air-fuel ratio sensor output value A/F is larger than the threshold value λA. As shown in FIG. 25, when the air-fuel ratio sensor output value A/F is equal to or less than the threshold value λA, determined of NO is made in S44. Subsequently, it is determined in S61 "vent valve open stuck" occurs.

Figure 26:
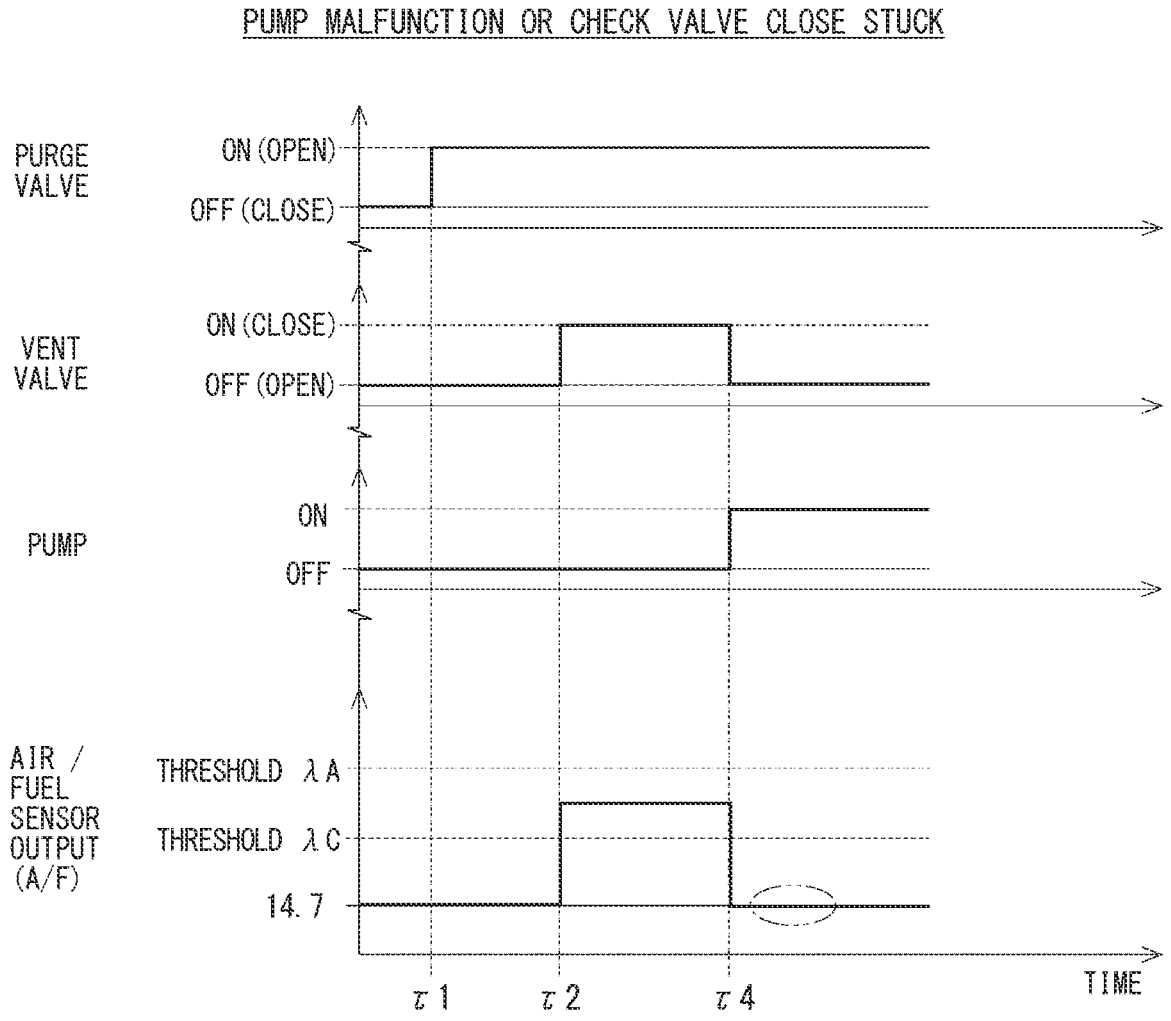
FIG. 26 is a time chart in the case of a pump malfunction or a check valve close stuck.

When determination of YES is made in S44, the vent valve 61 is opened in S48 at time τ4, and the pump 62 is turned on in S49. When the pump 62 is normal, the evaporated fuel is drawn toward the atmosphere opening 33, and introduction of the evaporated fuel into the intake passage 45 is avoided. Therefore, the air-fuel ratio A/F is supposed to increase. In S50, it is determined whether the air-fuel ratio sensor output value A/F is larger than the threshold value λC. As shown in FIG. 26, when the air-fuel ratio sensor output value A/F is equal to or less than the threshold value λC, determination of NO is made in S50. Subsequently, it is determined in S623 that "pump malfunction or check valve close stuck" occurs.

Figure 27:
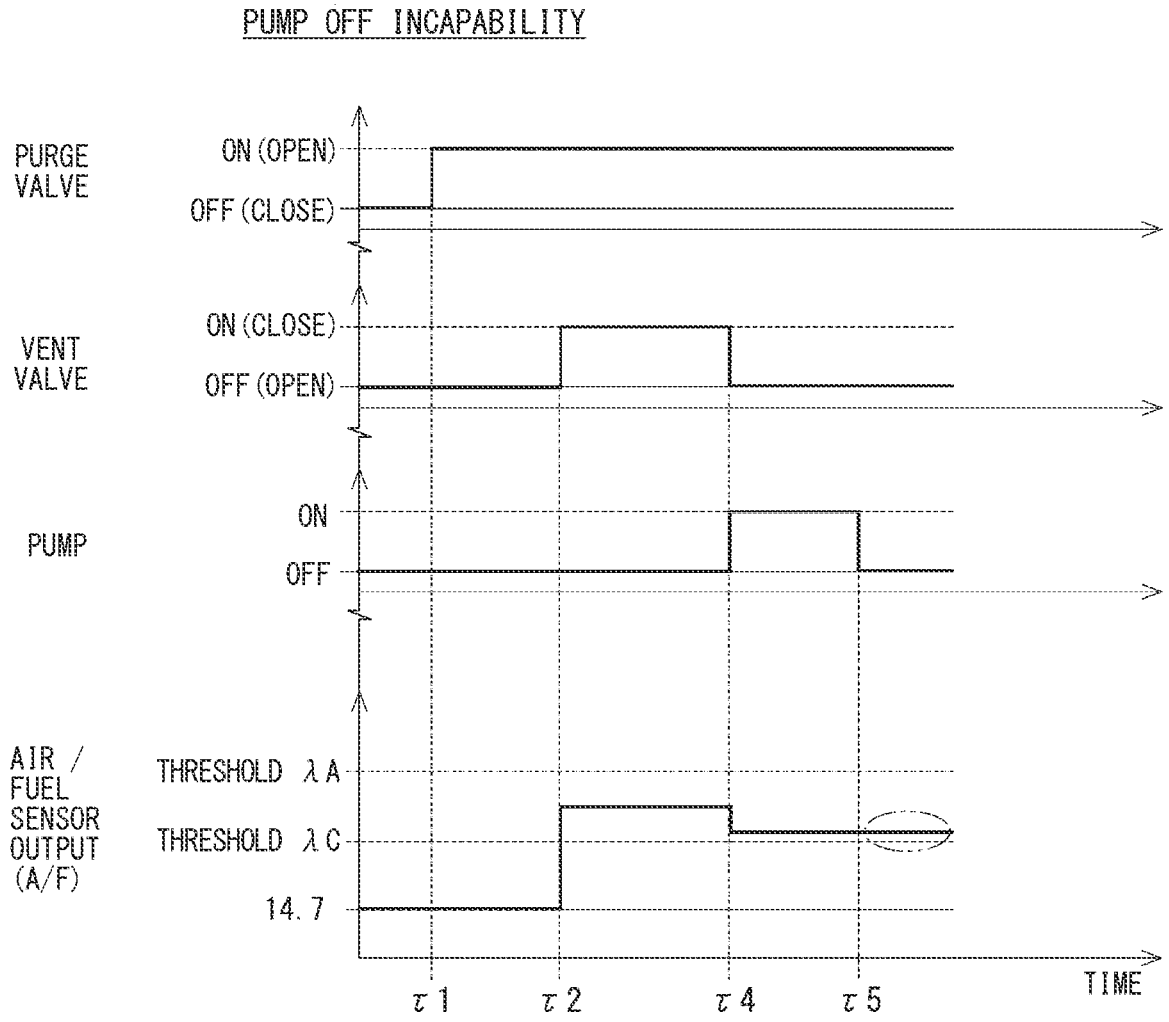
FIG. 27 is a time chart in a case of a pump off incapability.

When determination of YES is made in S50, the pump 62 is turned off in S51 at time τ5. When the pump 62 stops normally, the suction of the evaporated fuel is stopped, and the air-fuel ratio A/F is supposed to approach the ideal value. In S52, it is determined whether the air-fuel ratio sensor output value A/F is equal to or less than the threshold value λC. As shown in FIG. 27, when the air-fuel ratio sensor output value A/F is larger than the threshold value λC, determination of NO is made in S52. Subsequently, it is determined in S66 that "pump off incapability" occurs.

In summary, the malfunction diagnosis of the third embodiment includes the step of evaluating the output value of the air-fuel ratio sensor in one or more of the following states (1) to (3). In this way, the malfunction diagnostic device 80 is capable of performing malfunction diagnosis of the leakage diagnostic device 60 based on the air-fuel ratio sensor output value A/F. Therefore, the malfunction diagnostic device 80 is capable of appropriately discriminating between the leakage of the evaporative fuel treatment device 10 and the malfunction of the leakage diagnostic device 60.

(1) A state where the vent valve 61 is opened and where the pump 62 is turned off. S42 corresponds to this state.

(2) A state where the vent valve 61 is closed and where the pump 62 is turned off. S44 corresponds to this state.

(3) A state where the vent valve 61 is opened and where the pump 62 is turned on. S50 corresponds to this state.

Fourth Embodiment

As described above, the pumps 62 of the first to third embodiments is configured to pump gas in the second atmospheric passage 32 from the side of the canister 23 toward the atmospheric opening 33. The operation of the pump 62 depressurizes the second atmospheric passage 32 between the canister 23 and the pump 62. On the other hand, a configuration in which the pumping direction of the pump 62X is opposite to that of the first to third embodiments will be described as the fourth embodiment. The malfunction diagnosis of the fourth embodiment will be described with reference to FIGS. 28 to 38.

Figure 28:
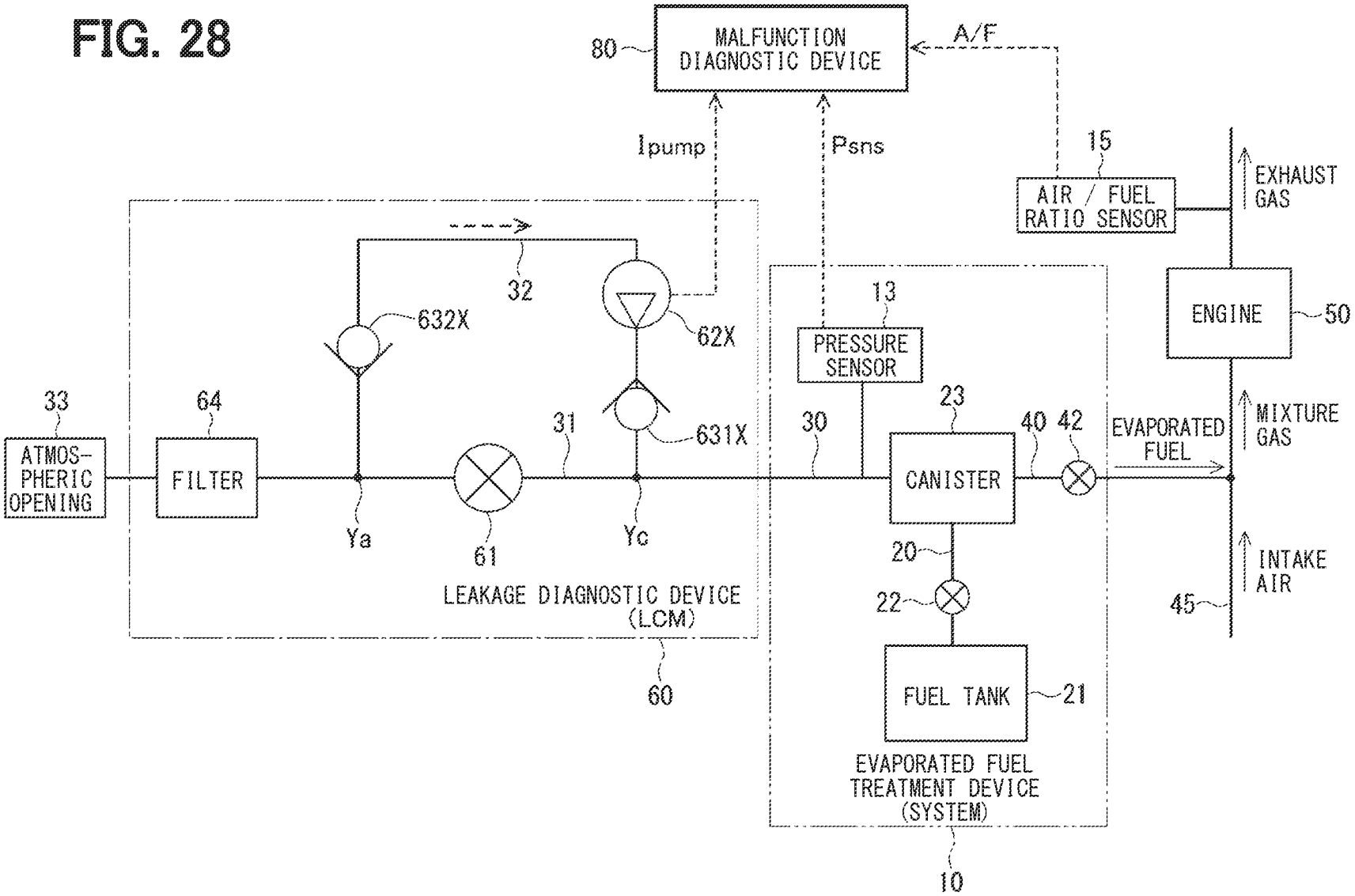
FIG. 28 is a diagram showing a configuration of an evaporative fuel treatment device and a leakage diagnostic device according to a fourth embodiments.

As shown in FIG. 28, in the fourth embodiment, the pumping direction of the pump 62X and the directions of the check valves 631X and 632X in the second atmospheric passage 32 of the leakage diagnostic device 60 are opposite to those in the configuration shown in FIG. 1. Therefore, the pumps 62X of the fourth embodiment is configured to pump gas in the second atmospheric passage 32 from the side of the atmospheric opening 33 toward the canister 23. The operation of the pump 62 pressurizes the second atmospheric passage 32 between the canister 23 and the pump 62.

The malfunction diagnosis in the leakage diagnostic device 60 having this configuration can be performed based on the pressure sensor output value Psns by changing the relationship between the pressure sensor output value Psns and the threshold value in some steps, while generally using the concept of the malfunction diagnosis of the first embodiment. The flowcharts and time charts of FIGS. 29 to 38 correspond to FIGS. 3 to 12 of the first embodiment, respectively. Hereinafter, the differences from the first embodiment will be mainly described.

Figure 3:
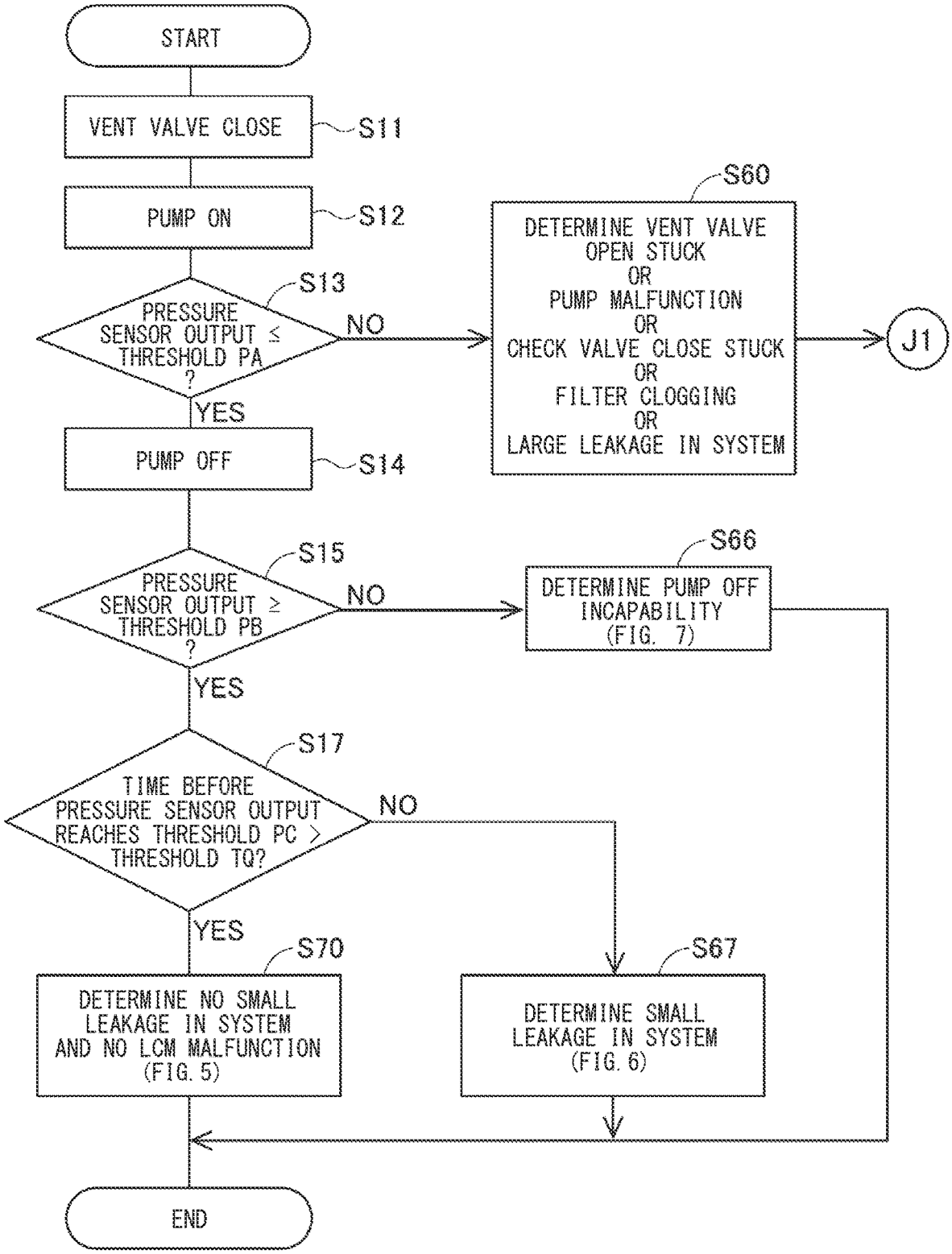
FIG. 3 is a flowchart (1) showing a malfunction diagnosis implemented by a malfunction diagnostic device of the first embodiment.
Figure 29:
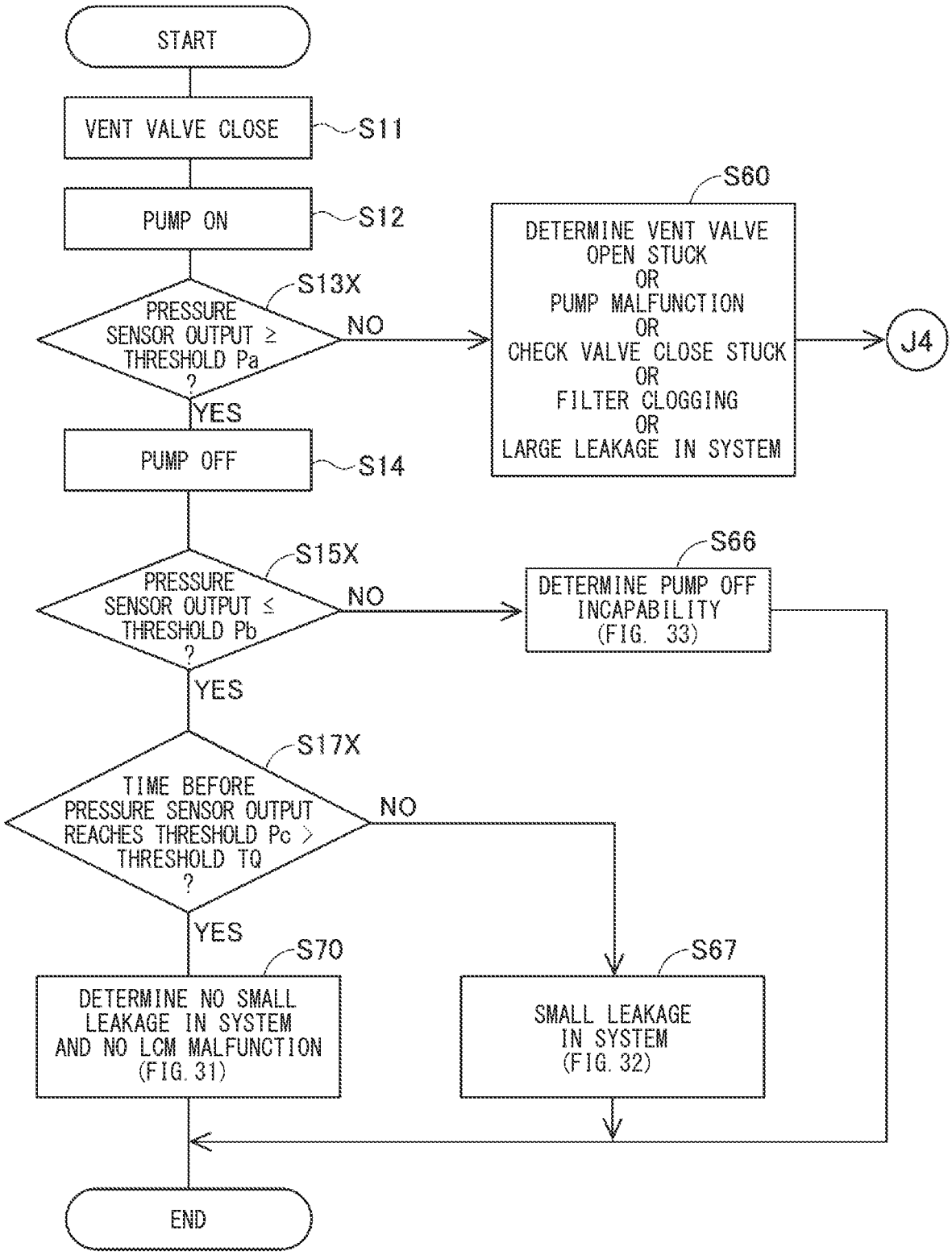
FIG. 29 is a flowchart (1) showing a malfunction diagnosis implemented by a malfunction diagnostic device of the fourth embodiment.
Figure 30:
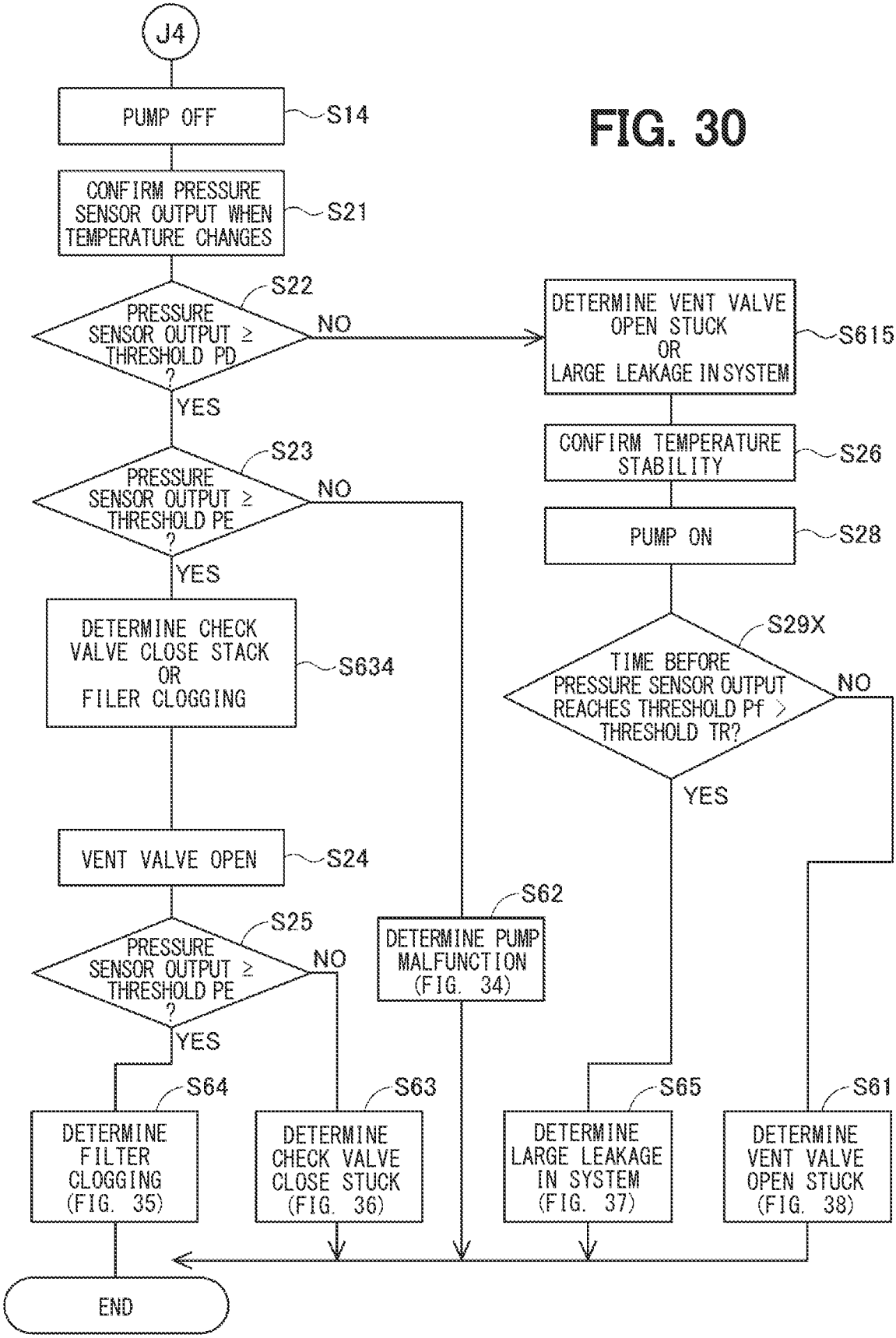
FIG. 30 is a flowchart (2) for the same malfunction diagnosis.

In the flowcharts of FIGS. 29 and 30, "X" is added to the end of the numbers of steps that are partially different from those of FIGS. 3 and 4. The threshold symbols of S13X, S15X, S17X, and S29X and the orientations of the inequality signs of S13X and S15X are different from those of FIGS. 3 and 4. The positive pressure thresholds Pa, Pb, Pc, and Pf in the time charts of FIGS. 31 to 38 are values that are obtained by inverting the negative pressure thresholds PA, PB, PC, and PF in FIGS. 5 to 14 to the positive side with respect to the atmospheric pressure, respectively.

The pressure thresholds PD and PE used for the diagnosis when the system temperature increases are similar to those in the first embodiment. Therefore, in the fourth embodiment, the pressure thresholds have the relationships of "Pb>Pa>Pc>atmospheric pressure", "PE>PD>atmospheric pressure", and "Pa>Pf>atmospheric pressure". A malfunction diagnosis similar to that of the first embodiment except for the change in the relationships of the pressure thresholds can be performed in this way.

Figure 31:
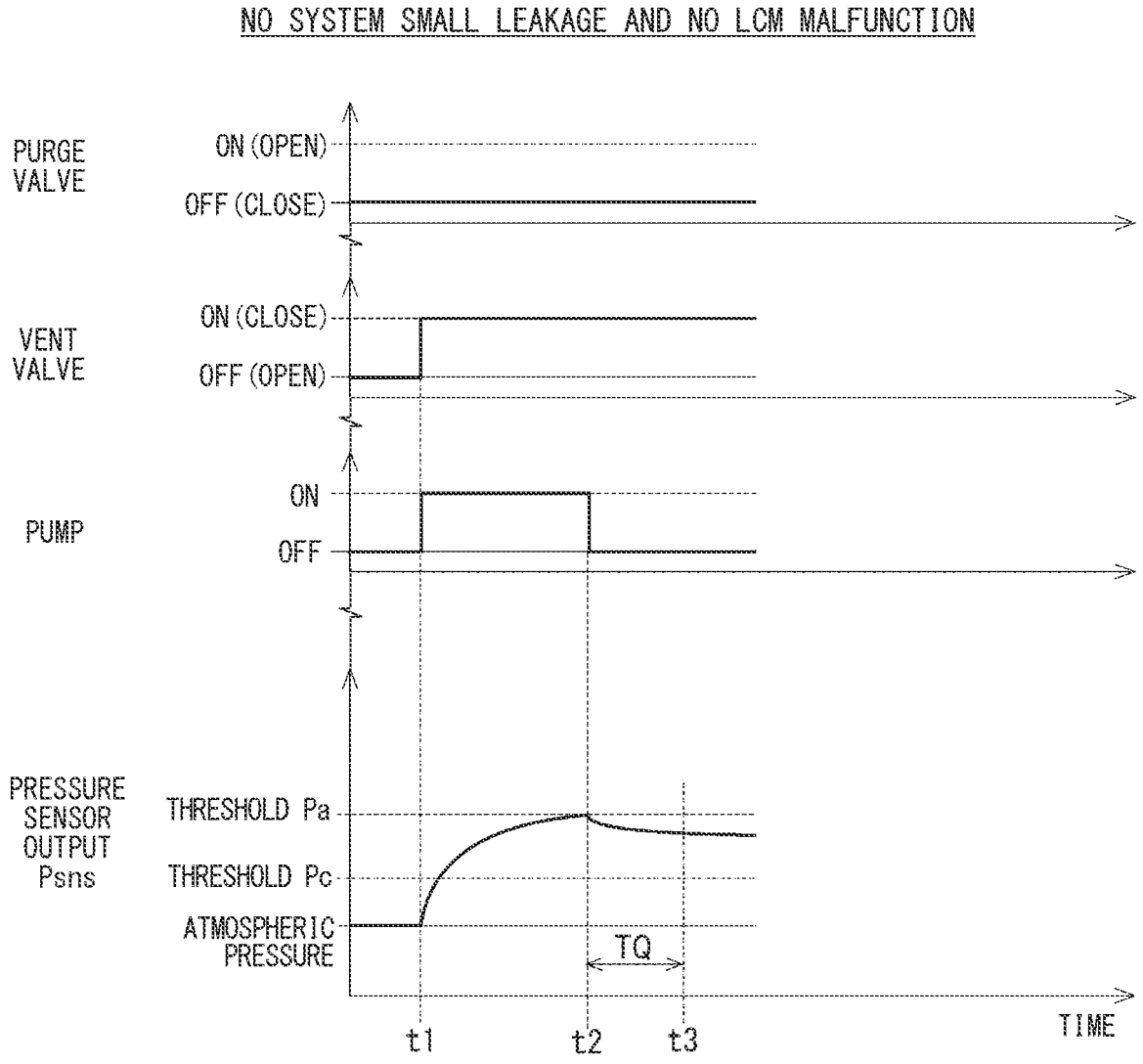
FIG. 31 is a time chart in a case of no system small leakage and no LCM malfunction.
Figure 32:
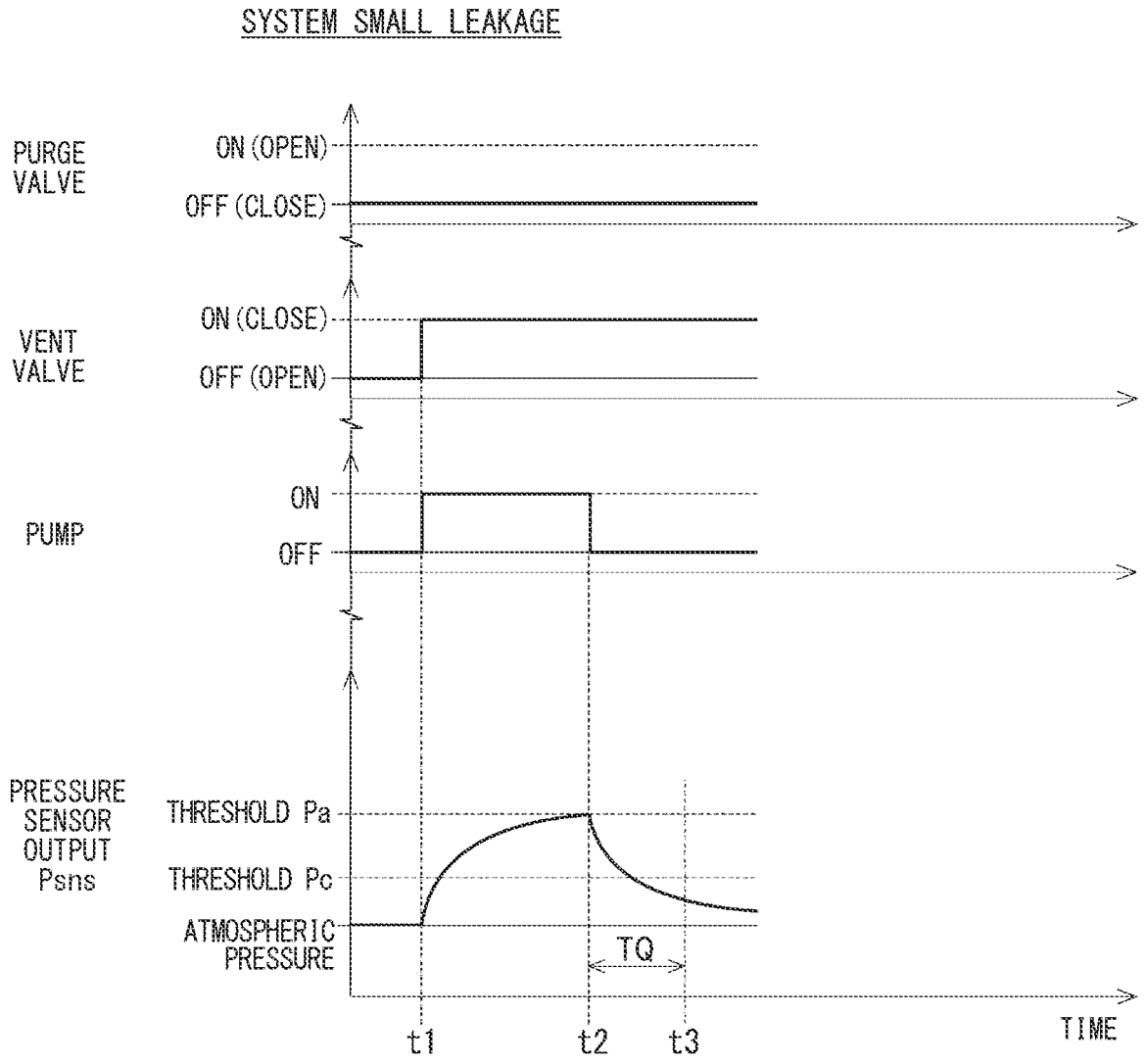
FIG. 32 is a time chart in a case of a system small leak.
Figure 33:
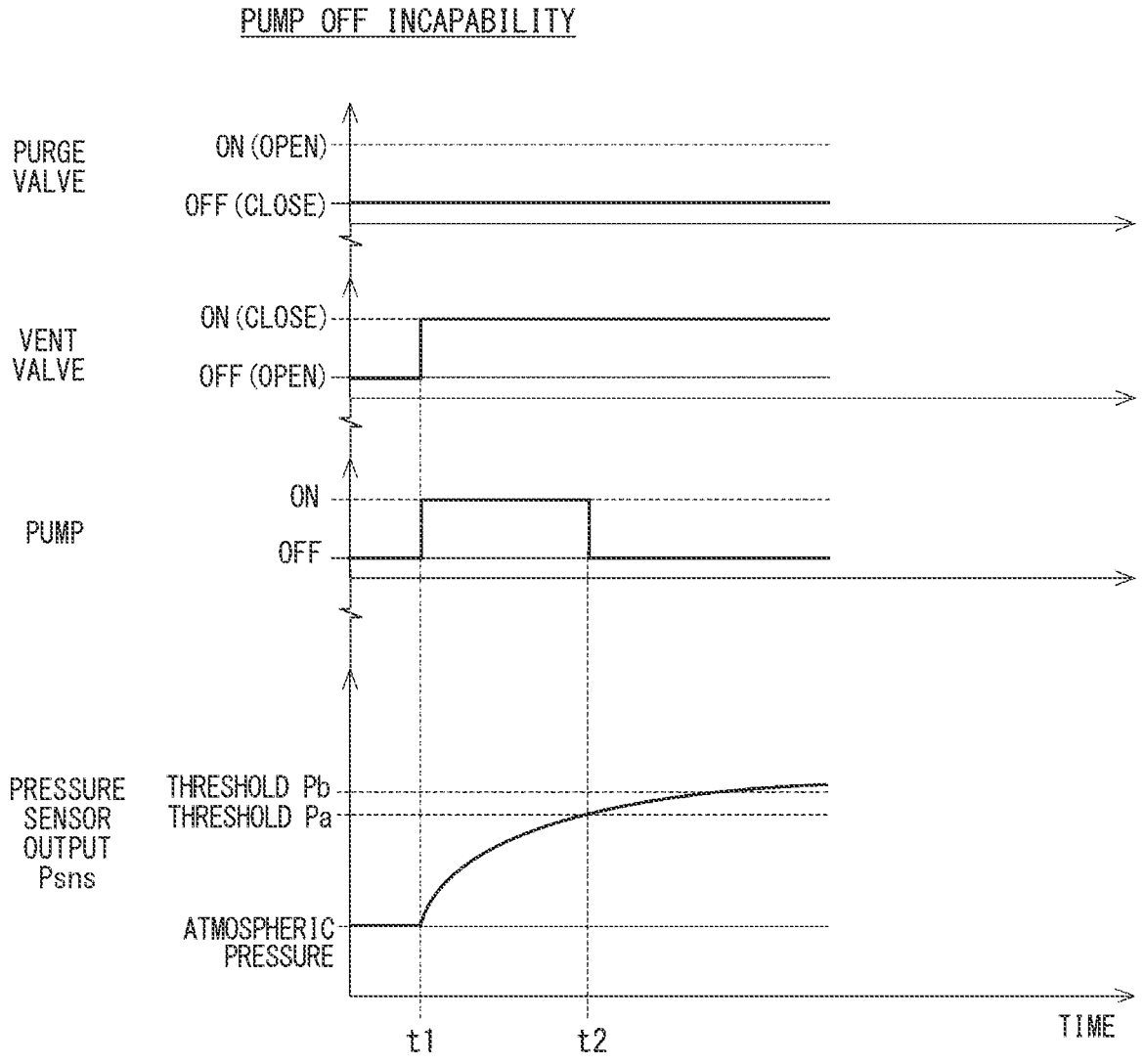
FIG. 33 is a time chart in a case of a pump off incapability.
Figure 34:
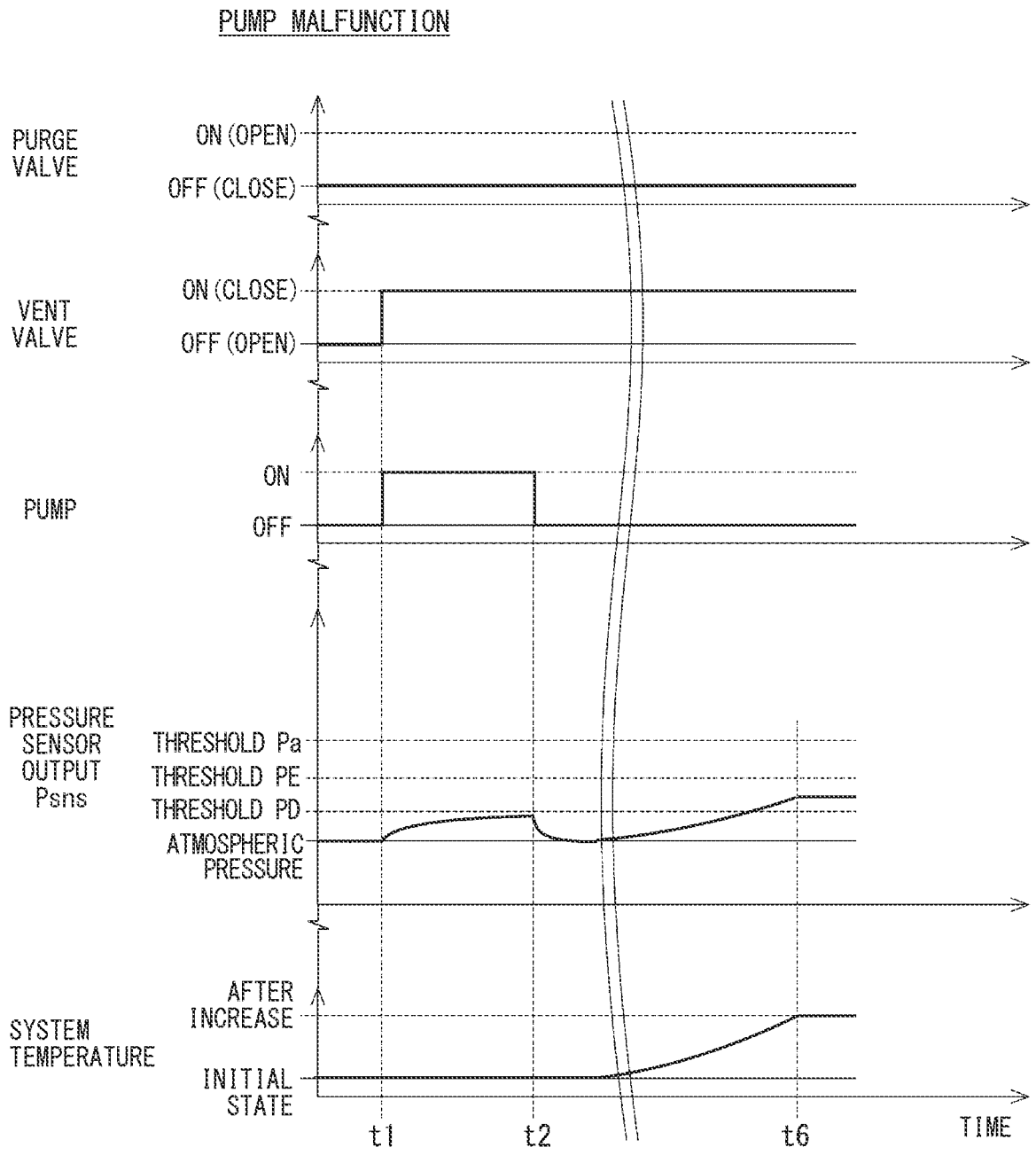
FIG. 34 is a time chart in a case of a pump malfunction.

As shown in FIG. 31, in S70 in FIG. 29, it is determined in S70 that "no small leakage in the system and no LCM malfunction" occurs. In S67, as shown in FIG. 32, it is determined that "small leakage in system" occurs. In S66, as shown in FIG. 33, it is determined that "pump off incapability" occurs. In S62, as shown in FIG. 34, it is determined that "pump malfunction" occurs.

Figure 35:
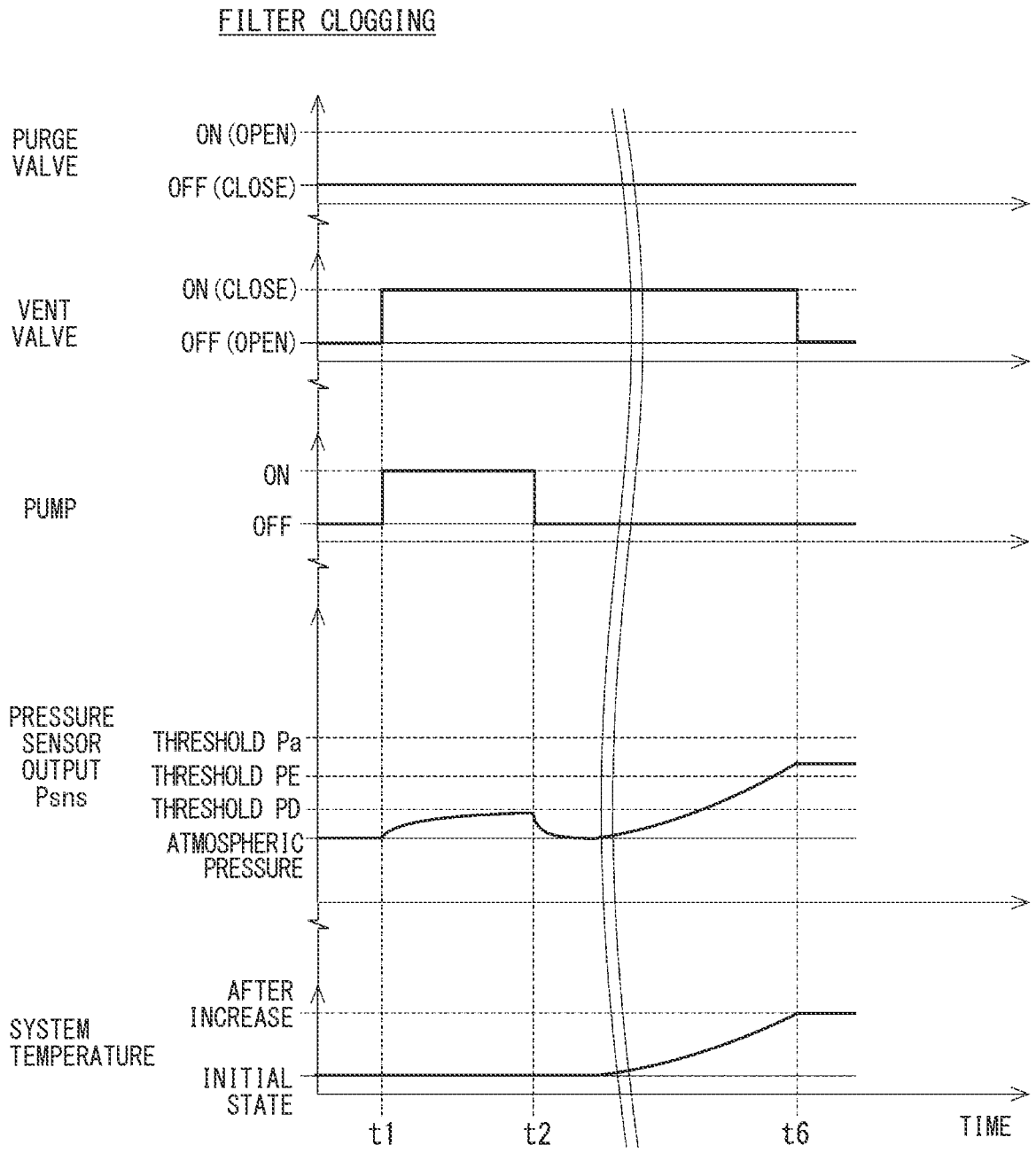
FIG. 35 is a time chart in a case of a filter clogging.
Figure 36:
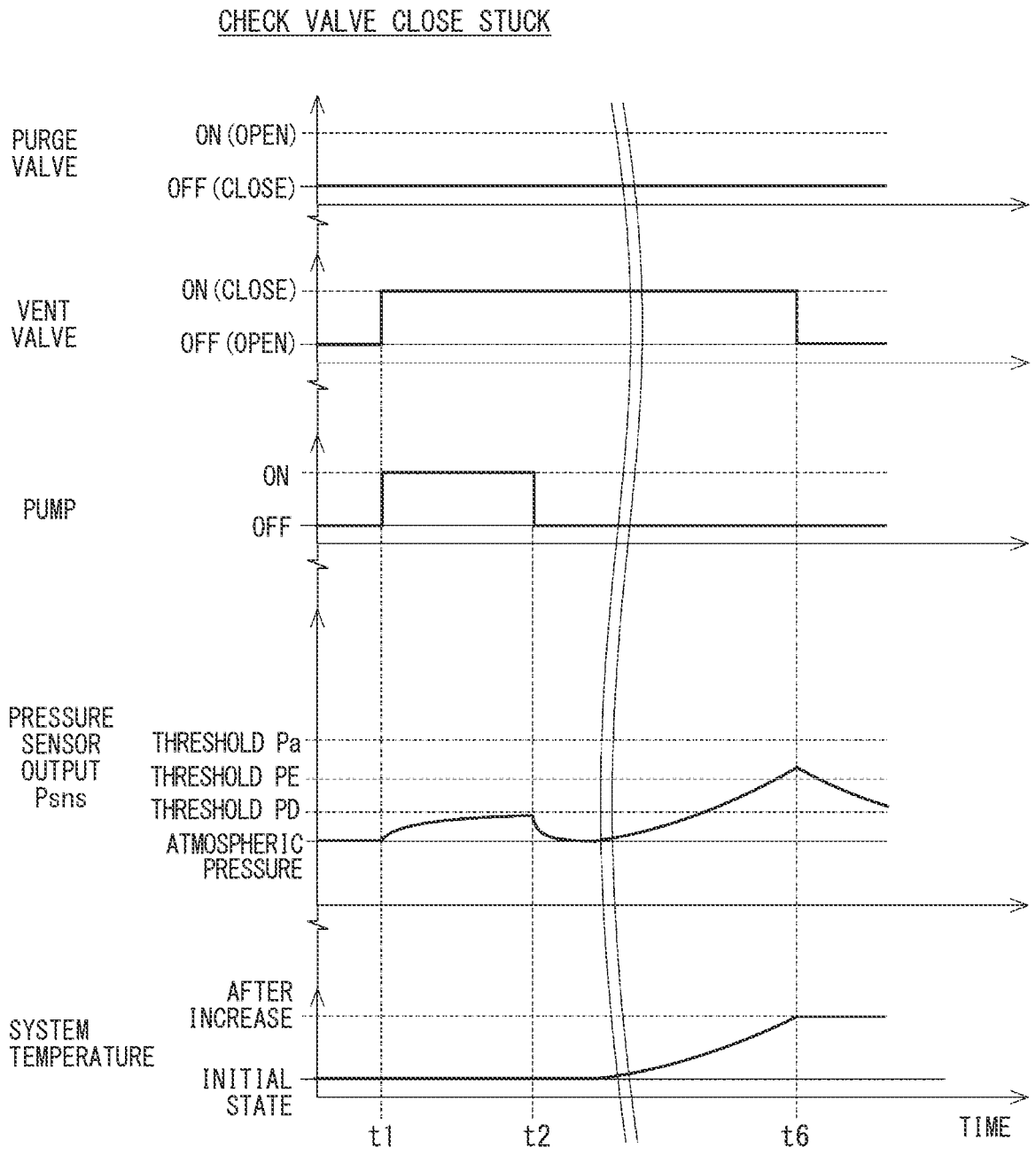
FIG. 36 is a time chart in a case of a check valve close stuck.
Figure 37:
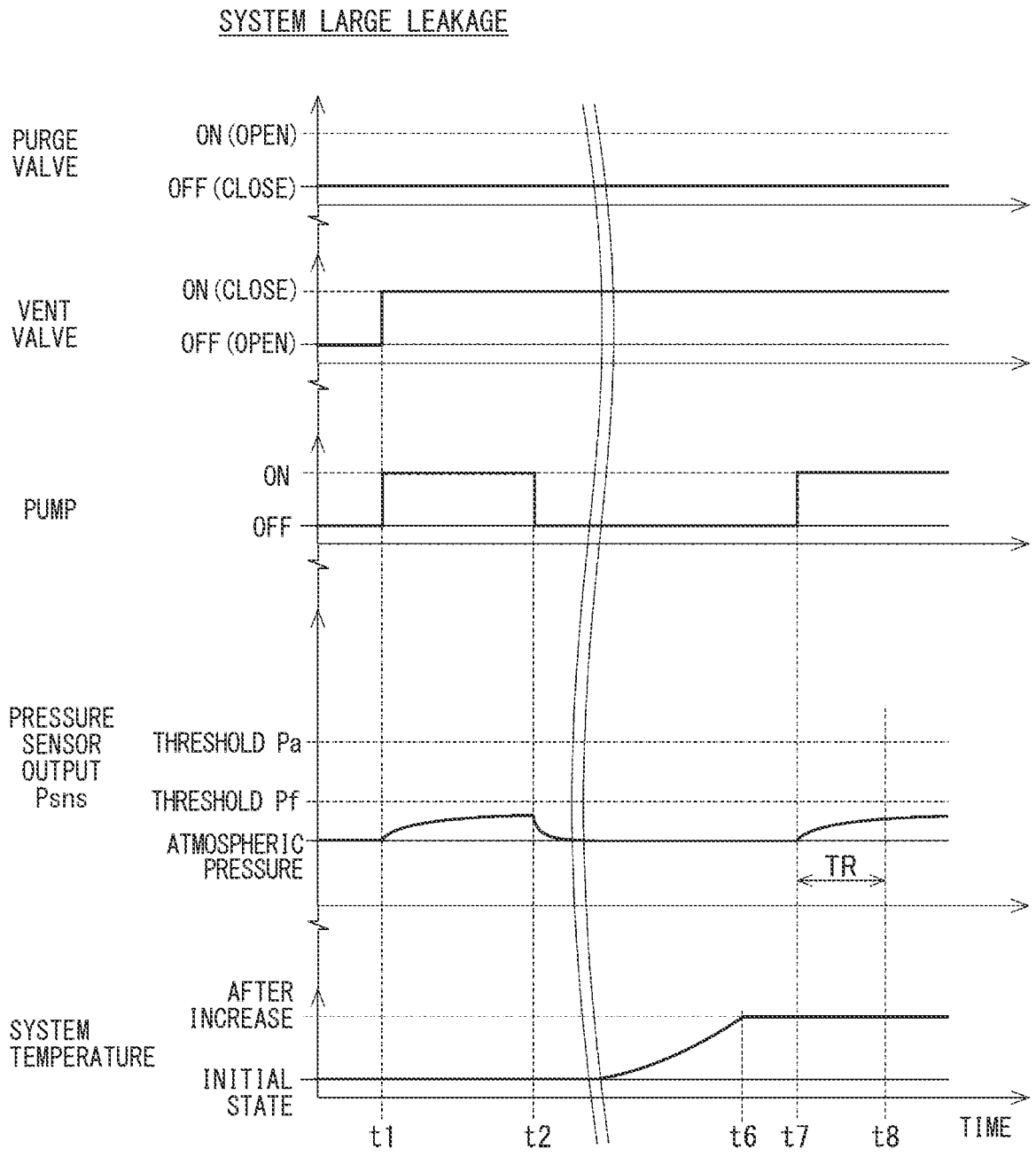
FIG. 37 is a time chart in a case of a system large leak.
Figure 38:
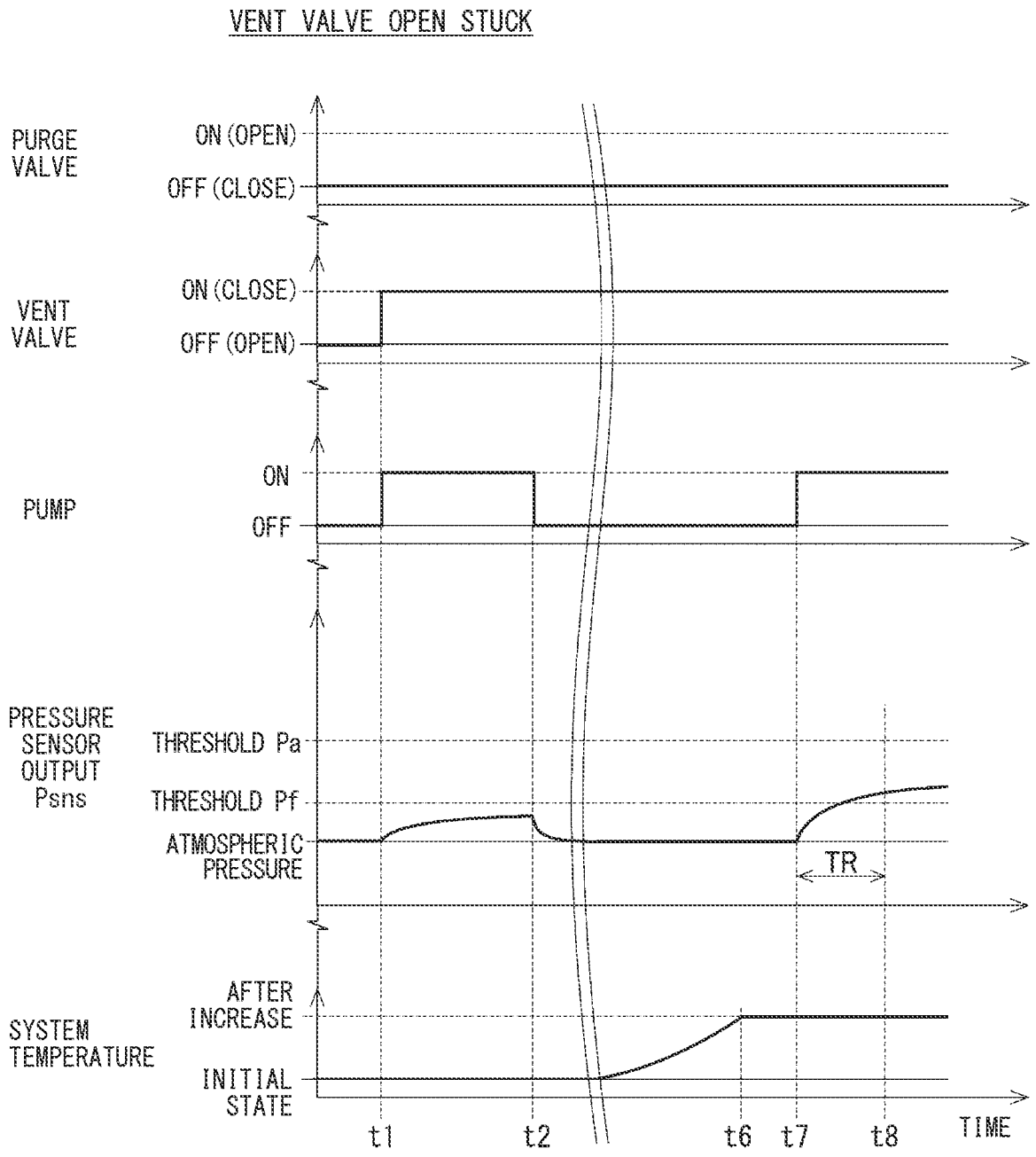
FIG. 38 is a time chart in a case of a vent valve open stuck.

In S64 of FIG. 30, as shown in FIG. 35, it is determined that "filter clogging" occurs. In S63, as shown in FIG. 36, it is determined that "check valve is close stuck" occurs. In S65, as shown in FIG. 37, it is determined that "large leakage in system" occurs. In S61, as shown in FIG. 38, it is determined that "vent valve open stuck" occurs.

Even in the configuration of the fourth embodiment, in which the pumping direction of the pump 62X of the leakage diagnostic device 60 is opposite, various types of malfunction diagnosis of the leakage diagnostic device 60 can be performed. Therefore, the malfunction diagnostic device 80 is capable of appropriately discriminating between the leakage of the evaporative fuel treatment device 10 and the malfunction of the leakage diagnostic device 60.

Other Embodiments (a) The malfunction diagnosis of the first and second embodiments is not limited to be performed with the purge valve 42 that is regularly closed. The malfunction diagnosis may be performed with the purge valve 42 that is opened, as long as the pressure of the system can be detected.

(b) The pressure change "at the time of temperature change" in S21 of the first embodiment is not limited to the pressure increase caused by the temperature increase. Pressure decrease cause by temperature decrease may be used. In this case, in addition to forcedly cooling the system with a fan or the like, decrease in the system temperature after the engine is stopped may be used, and/or the system may wait for the temperature of the system to decrease as the temperature decrease in the night time.

(c) In the step of evaluating the change in the pressure sensor output value Psns from a certain operation, the method of comparing the time, which is for the pressure sensor output value Psns to reach the predetermined pressure threshold value, with the predetermined time threshold value corresponds to an evaluation based on an average rate. In addition, for example, the change may be evaluated based on an instantaneous rate calculated from a difference in the pressure sensor output value Psns in a minute time immediately after the operation.

(d) The order of steps in the flowchart of each of the above-described embodiments is an example. The order of steps may be changed as appropriate, as long as the malfunction diagnosis can be performed. Further, for example, in a case where it is known in advance that a certain element of the leakage diagnostic device 60 is normal, a part of step(s) may be omitted.

The present disclosure should not be limited to the embodiments described above, and various other embodiments may be implemented without departing from the scope of the present invention.

The controllers and methods described in the present disclosure may be implemented by a special purpose computer created by configuring a processor programmed to execute one or more particular functions embodied in computer programs. Alternatively, the apparatuses and methods described in the present disclosure may be implemented by special purpose hardware logic circuits. Further alternatively, the apparatuses and methods described in the present disclosure may be implemented by a combination of one or more special purpose computers created by configuring a processor executing computer programs and one or more hardware logic circuits. The computer programs may be stored, as instructions being executed by a computer, in a tangible non-transitory computer-readable medium.

What is claimed is:

1. A malfunction diagnostic device configured to perform malfunction diagnosis of a leakage diagnostic device, which is provided to an atmospheric passage to diagnose leakage of evaporated fuel in an evaporative fuel treatment device, the evaporative fuel treatment device configured to purge evaporated fuel, which is adsorbed on a canister, to an intake passage through a purge passage, the canister being connected to a fuel tank through a vapor passage and connected to an atmospheric opening through the atmospheric passage, the leakage diagnostic device includes a vent valve configured to block a first atmospheric passage, which is a main passage of the atmospheric passage and connects the canister with the atmospheric opening, a pump provided to a second atmospheric passage, which is a bypass passage of the first atmospheric passage and connects the canister with the atmospheric opening, and configured to pressurize and depressurize the second atmospheric passage, at least one check valve provided to the second atmospheric passage and configured to seal a flow in a direction opposite to a pumping direction of the pump, and a filter provided to the atmospheric passage on a side of the atmospheric opening, the malfunction diagnostic device comprising:

a processor configured to perform the malfunction diagnosis based on an output value of a pressure sensor that is configured to detect pressure in a passage connected to the canister, wherein the processor is configured to discriminate, based on the output value of the pressure sensor, between leakage of evaporated fuel and malfunction of at least one of the vent valve, the pump, the at least one check valve, or the filter.

2. The malfunction diagnostic device according to claim 1, wherein the processor is configured to, in the malfunction diagnosis, evaluate the output value of the pressure sensor with the vent valve that is closed and the pump that is turned on.

3. The malfunction diagnostic device according to claim 2, wherein the processor is configured to, in the malfunction diagnosis, evaluate a change in the output value of the pressure sensor immediately after the pump, which is turned on, is turned off with the vent valve that is closed.

4. The malfunction diagnostic device according to claim 2, wherein the processor is configured to, in the malfunction diagnosis, evaluate a change in the output value of the pressure sensor immediately after the pump, which is turned off, is turned on with the vent valve that is closed.

5. The malfunction diagnostic device according to claim 2, wherein the processor is configured to, in the malfunction diagnosis, evaluate the output value of the pressure sensor when an ambient temperature of the leakage diagnostic device changes with the vent valve that is closed and the pump that is turned off.

6. The malfunction diagnostic device according to claim 1, wherein the processor is configured to, based on the output value of the pressure sensor, discriminate among:

stuck of the vent valve, stuck of the at least one check valve, pump malfunction, in which the pump cannot be turned on, pump off incapability, in which the pump cannot be turned off, and clogging of the filter.

7. The malfunction diagnostic device according to claim 1, wherein the processor is configured to, when the output value of the pressure sensor does not become less than a threshold in a state where the vent valve is closed and where the pump is turned on, determine that at least one of the following occurs:

stuck of the vent valve, stuck of the at least one check valve, pump malfunction, in which the pump cannot be turned on, clogging of the filter, or occurrence of large leakage of evaporative fuel.

8. The malfunction diagnostic device according to claim 1, wherein the first atmospheric passage connects the canister, the vent valve, the filter, and the atmospheric opening directly with each other, and the second atmospheric passage is a bypass passage that connects a confluence point, which is in a passage between the vent valve and the canister, with a confluence point, which is in a passage between the vent valve and the filter.

* * * * *